US009156607B2

(12) United States Patent
Adams

(10) Patent No.: US 9,156,607 B2
(45) Date of Patent: Oct. 13, 2015

(54) COLLAPSIBLE INTERMODAL FLAT RACK

(71) Applicant: Fontaine Engineered Products, Inc., Jasper, AL (US)

(72) Inventor: James Adams, Jasper, AL (US)

(73) Assignee: FONTAINE ENGINEERED PRODUCTS, INC., Jasper, AL (US)

( * ) Notice: Subject to any disclaimer, the term of this patent is extended or adjusted under 35 U.S.C. 154(b) by 50 days.

(21) Appl. No.: 14/076,725

(22) Filed: Nov. 11, 2013

(65) Prior Publication Data

US 2014/0161555 A1 Jun. 12, 2014

Related U.S. Application Data

(60) Provisional application No. 61/724,547, filed on Nov. 9, 2012.

(51) Int. Cl.

| | |
|---|---|
| ***B65D 88/52*** | (2006.01) |
| ***B65D 88/12*** | (2006.01) |
| ***B65D 88/02*** | (2006.01) |

(52) U.S. Cl.

CPC ..... *B65D 88/129* (2013.01); *B65D 88/022* (2013.01); *B65D 88/52* (2013.01)

(58) Field of Classification Search

CPC ..... B65D 88/52
USPC ..... 410/46; 108/51.11, 53.1
See application file for complete search history.

(56) References Cited

U.S. PATENT DOCUMENTS

| | | | |
|---|---|---|---|
| 3,529,741 | A | 9/1970 | Walker et al. |
| 3,537,414 | A | 11/1970 | Goldman |
| 3,620,388 | A | 11/1970 | Mansson |
| 3,648,909 | A | 3/1972 | Wisecarver |
| 3,664,273 | A | 5/1972 | Howe |
| 3,665,869 | A | 5/1972 | Howe |
| 3,770,186 | A | 11/1973 | Kupersmit |
| 4,131,071 | A | 12/1978 | Glassmeyer |
| 4,162,737 | A | 7/1979 | Clive-Smith |
| 4,319,732 | A | 3/1982 | Godfrey |
| 4,339,047 | A | 7/1982 | Johansson et al. |
| 4,353,520 | A | 10/1982 | Jansson |

(Continued)

FOREIGN PATENT DOCUMENTS

| | | |
|---|---|---|
| EP | 1127009 | 5/2005 |
| EP | 1326791 | 6/2006 |

(Continued)

OTHER PUBLICATIONS

International Search Report and Written Opinion form PCT/US2013/069448 issued on Apr. 4, 2014.

(Continued)

*Primary Examiner* — Hilary Gutman

(74) *Attorney, Agent, or Firm* — R. Blake Johnston; DLA Piper LLP (US)

(57) ABSTRACT

A collapsible intermodal flat rack features a cargo deck with first and second arches pivotally mounted to the cargo deck. Each arch is provided with a crank mechanism including a gearbox having an input shaft and an output shaft. The output shaft is attached to the corresponding arch so that the arch may be moved between a storage position, where a top portion of the arch is located adjacent to the cargo deck, and a use position, where the top portion of the arch is elevated from the cargo deck, by actuation of the input shaft.

37 Claims, 31 Drawing Sheets

(56) References Cited

U.S. PATENT DOCUMENTS

| | | | |
|---|---|---|---|
| 4,527,765 | A | 7/1985 | Dorpmund et al. |
| 4,535,896 | A | 8/1985 | Evenson |
| 4,618,068 | A | 10/1986 | Born |
| 4,630,746 | A | 12/1986 | Fortenberry |
| 4,638,744 | A | 1/1987 | Clive-Smith |
| 4,678,389 | A | 7/1987 | Bonerb |
| 4,785,957 | A | 11/1988 | Beck et al. |
| 4,796,539 | A | 1/1989 | Berrett |
| 4,919,263 | A | 4/1990 | Baltzer et al. |
| 4,946,214 | A | 8/1990 | Neumann et al. |
| 4,966,085 | A | 10/1990 | Howe |
| 5,169,011 | A | 12/1992 | Ebeling et al. |
| 5,275,301 | A | 1/1994 | Clive-Smith |
| 5,415,311 | A | 5/1995 | Coogan |
| 5,449,082 | A | 9/1995 | Reynard |
| 5,494,182 | A | 2/1996 | Clive-Smith |
| 5,507,608 | A | 4/1996 | Forslind |
| 5,639,174 | A | 6/1997 | Gonska |
| 5,644,992 | A | 7/1997 | Clive-Smith |
| 5,678,715 | A | 10/1997 | Sjostedt et al. |
| 5,720,228 | A | 2/1998 | Clive-Smith |
| 5,755,472 | A | 5/1998 | Clive-Smith |
| 5,791,579 | A | 8/1998 | Raphael et al. |
| 5,810,186 | A | 9/1998 | Lam |
| 5,918,744 | A | 7/1999 | Bringard et al. |
| 5,938,059 | A | 8/1999 | Luburic |
| 5,941,398 | A | 8/1999 | Harris |
| 6,112,929 | A | 9/2000 | Ota |
| 6,279,763 | B1 | 8/2001 | Bush |
| 6,317,981 | B1 | 11/2001 | Clive-Smith |
| 6,513,442 | B1 | 2/2003 | Miller et al. |
| 6,572,325 | B2 | 6/2003 | Kelly |
| 6,866,160 | B2 | 3/2005 | Wang et al. |
| 7,044,065 | B2 | 5/2006 | Arai et al. |
| 7,140,821 | B2 | 11/2006 | Sain |
| 7,491,024 | B2 | 2/2009 | Heinrichs et al. |
| 7,739,965 | B2 | 6/2010 | Heinrichs et al. |
| 7,802,526 | B2 | 9/2010 | Brady et al. |
| 7,823,739 | B2 | 11/2010 | Sadkin et al. |
| 7,931,164 | B2 | 4/2011 | Krohn |
| 7,984,819 | B1 | 7/2011 | Davis |
| 8,002,134 | B2 | 8/2011 | Whyte |
| 8,196,766 | B2 | 6/2012 | Schrayvogel |
| 8,210,374 | B2 | 7/2012 | Harpole |
| 8,240,496 | B2 | 8/2012 | Kong et al. |
| 8,286,562 | B2 | 10/2012 | Reynard |
| 8,342,784 | B2 | 1/2013 | Crane et al. |
| 8,347,560 | B2 | 1/2013 | Gyory et al. |
| 2004/0222219 | A1 | 11/2004 | Taylor |
| 2004/0232146 | A1 | 11/2004 | Kessler et al. |
| 2007/0206999 | A1 | 9/2007 | Clive-Smith |
| 2008/0210687 | A1 | 9/2008 | Clive-Smith |
| 2010/0122981 | A1 | 5/2010 | Sims |
| 2010/0135742 | A1 | 6/2010 | Sain |
| 2010/0140277 | A1 | 6/2010 | Clive-Smith |
| 2010/0294785 | A1 | 11/2010 | Massa |
| 2011/0024435 | A1 | 2/2011 | MacNabb |
| 2011/0073595 | A1 | 3/2011 | Crane |
| 2011/0155025 | A1 | 6/2011 | Reynard |
| 2012/0048846 | A1 | 3/2012 | Choi |
| 2012/0076605 | A1 | 3/2012 | Crane et al. |

FOREIGN PATENT DOCUMENTS

| | | |
|---|---|---|
| GB | 1258284 | 12/1971 |
| GB | 2097364 | 11/1982 |
| GB | 2244090 | 11/1991 |
| GB | 2261259 | 5/1993 |
| GB | 2303360 | 2/1997 |
| GB | 2350862 | 12/2000 |
| GB | 2353275 | 2/2001 |
| GB | 2355451 | 4/2001 |
| GB | 2361961 | 11/2001 |
| GB | 2376014 | 12/2002 |
| GB | 2393435 | 3/2004 |
| WO | WO 95/12536 | 5/1995 |
| WO | WO 98/09889 | 3/1998 |
| WO | WO 01/98181 | 12/2001 |
| WO | WO 02/057113 | 7/2002 |
| WO | WO 2003/010051 | 2/2003 |
| WO | WO 2005/066045 | 7/2005 |
| WO | WO 2006/005920 | 1/2006 |
| WO | WO 2007/071942 | 6/2007 |
| WO | WO 2009/064178 | 5/2009 |
| WO | WO 2009/106521 | 9/2009 |
| WO | WO 2010/041222 | 4/2010 |

OTHER PUBLICATIONS web.archive.org/web/20100317011105/http://www.cargomar.it/index.php/en/page/containers/4/1, Feb. 8, 2013.

web.archive.org/web/20100304052241/http://www.globalindustrial.com/g/storage/bins-totes-containers/folding/plastic-folding-bulk-containers, Feb. 8, 2013.

48ft Domino Type (13) lightweight intermodal, Domino Collapsible Flatrack, http://www.seabox.com/catdl/sb4/SB47138/SB47138.pdf, May 1, 2013.

45ft Domino Type (13) ISO/European/Intermodal use, Domino Flatracks, http://www.flatrackcontainers.com/product_info.asp?ProductID=Dom45_T13, Dec. 13, 2003.

S. Luna, "Intermodal Flat Rack Test", Transportation Technology Center, Inc., pp. 1-9, Jan. 14, 2010.

40ft Type 4, 40ft Domino Type (4) with flush folding endwalls, http://www.seabox.com/catdl/sb4/SB4744/SB4744.pdf, Apr. 30, 2013.

Flat Rack Collapsiblecontainers, East & West Express, http://www.ewexpress.com/serv/flatrackcolable.html, Jul. 10, 2014.

"Container Specification", Hapag-Lloyd, http://www.hapag-lloyd.com/downloads/press_and_media/publications/Brochure_Container_Specification_en.pdf, pp. 1-48, Apr. 30, 2013.

K. Priyo, "Containing Space—Four in a Box", LOG.indian, pp. 36-38, Jun. 30, 2008.

R. Konings et al. "Foldable Containers: a New Perspective on Reducing Container-Repositioning Costs Technological logistic and economic issues", EJTIR, 1, No. 4 (2001), pp. 333-352.

Domino Flatracks, http://web.archive.org/web/20050126222839/http://flatrackcontainers.com/, Feb. 25, 2014.

Cargoshell Takes a bow Container and swap-doby leasing, Container manuf . . . , http://www.worldcargonews.com/htm/w20090731.494733.htm, Feb. 20, 2014.

A. Branch, "Export Practice and Management", Fifth Edition; Thomson Learning; 2006, pp. 85-86, 88, 92.

Anonymous, "SOLE's Newest Corporate Member . . . " Logistics Spectrum; Jul.-Sep. 2006; 40, 3; ProQuest Research Library, pp. 36.

Flat Rack and Flatbed Container Photo Gallery, http://www.mattsplace.com/intermodal, Feb. 20, 2014.

2009 TAL International Container Corporation, Equipment Page, www.talinternational.com, Feb. 20, 2014.

ISO Shipping Containers, Refrigerated, Storage & Cargo Containers, http://seabox.com/, Feb. 20, 2014.

English Translation of FR2811252 published Jan. 11, 2002.

English Translation of EP 0069043 published Jan. 5, 1983.

Petition for Inter Parties Review of U.S. Pat. No. 8,342,784 Under 35 U.S.C. §§ Under 35 U.S.C. §§ 311-319 and 37 C.F.R. §§ 42.1-.80, 42.100-.123; Case No. IPR2013-00360 filed on Jun. 14, 2013.

Exhibit 1007 from Case No. IPR2013-00360 filed Jun. 14, 2013.

Petition for Inter Parties Review of U.S. Pat. No. 8,342,784 Under 35 U.S.C. §§ Under 35 U.S.C. §§ 311-319 and 37 C.F.R. §§ 42.1-.80, 42.100-.123; Case No. IPR2013-00361 filed on Jun. 14, 2013.

Exhibit 1014 from Case No. IPR2013-00361 filed Jun. 14, 2013.

International Preliminary Report on Patentability from PCT/US2013/069448 dated May 12, 2015.

COLLAPSIBLE INTERMODAL FLAT RACK

CLAIM OF PRIORITY

This application claims priority to U.S. Provisional Patent Application No. 61/724,547, filed Nov. 9, 2012, the contents of which are hereby incorporated by reference.

FIELD OF THE INVENTION

The present invention relates to shipping containers and, more particularly, to a collapsible intermodal flat rack.

BACKGROUND

The term "intermodal" refers to a manner of transporting cargo by way of ships, semi-trailer trucks and/or railways. Cargo containers used during intermodal transport have been standardized to facilitate international trade. Indeed, the cargo containers must pass the certification tests of the International Organization for Standardization (ISO) for durability if they are to be used for both domestic and international transport. The moat widely used ISO classification of container is the 1AA class. Such containers are 40 foot long, 8 foot in wide and 8.5 foot high and have lifting and stacking points at the tops of their four corners. As a result, cargo handling and transport equipment, such as cranes, trucks, trailers, railway cars, etc., have been built to accept containers having such fitments.

The weight capacity of a cargo container is often limited by the weight of the container itself. In other words, if the container is made lighter, it may be used to carry a heavier cargo load. As a result, collapsible intermodal flat racks, such as the flat racks offered by Domino Flatracks (Clive-Smith Cowley Ltd) of the United Kingdom and illustrated in published UK Patent Application GB 2376014 and U.S. Pat. No. 5,275,301, both to Clive-Smith, have been developed. Such collapsible intermodal flat racks omit the container side and end walls and top and instead feature a floor or cargo deck that features arches that are pivotally attached to move between an upright use position, a folded stored position and an expanded position for placing a load on the cargo deck from above (such as by crane).

In addition to offering a weight savings, such collapsible intermodal flat racks permit the cargo deck to be longer than 40 foot as the arches feature lifting and stacking fitments and are positioned inward from the flat rack ends and 40 foot apart to permit handing by standardized equipment.

In addition, the collapsible intermodal flat racks permit the flat racks, when in the collapsed storage configuration, to be stacked for transport. As a result, the necessity of returning an empty cargo container is avoided. Instead, a number of collapsed intermodal flat racks may be transported in the same space required to return a single empty non-collapsible ISO class 1AA container.

While the collapsible intermodal flat racks of Clive-Smith offer the above advantages, changing the configuration of the arches or vertical uprights is laborious in that they must be directly lifted and handled and manually moved between the use, storage and expanded load positions. One solution to this problem is offered in U.S. Pat. No. 7,823,739 to Sadkin et al., where end walls of a collapsible shipping container are moved by a support or lever on each side having one end pivotally attached to the end wall, and a second end that moves within a track formed on the side of the cargo deck beam. A hydraulic or electric motor is positioned under the deck and moves the ends of the levers positioned within the tracks so that they travel towards the longitudinal center of die cargo deck thus causing the end walls to fold. The disadvantage of this approach, however, is that a source of power, either onboard or off is required. Furthermore, the motor mechanism adds to the cost and complexity.

DETAILED DESCRIPTION OF EMBODIMENTS

Figure 1A:
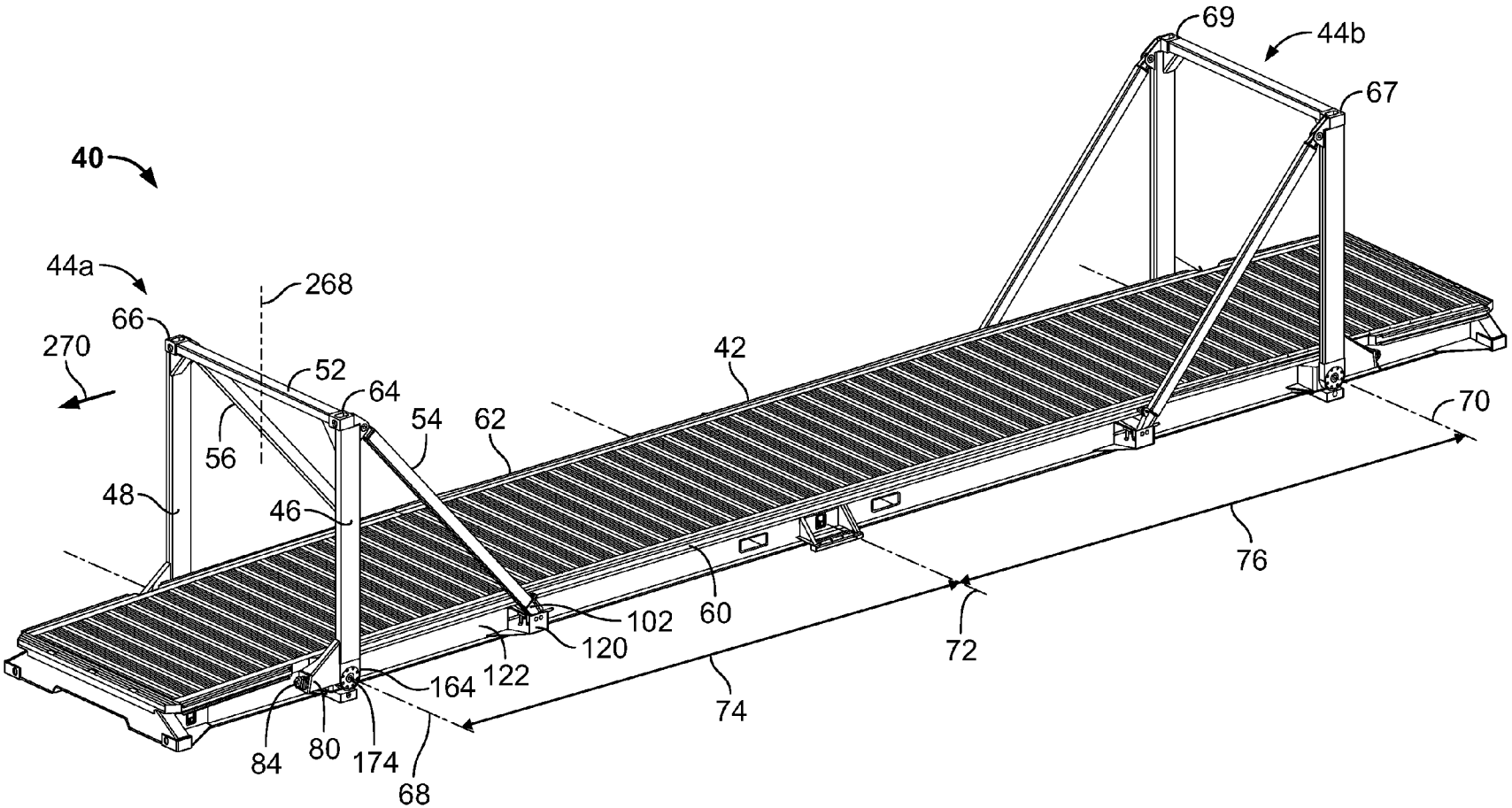
FIGS. 1A-1C are perspective views of an embodiment of the collapsible intermodal flat rack of the present invention in the use, storage and expanded load configurations, respectively.
Figure 1B:
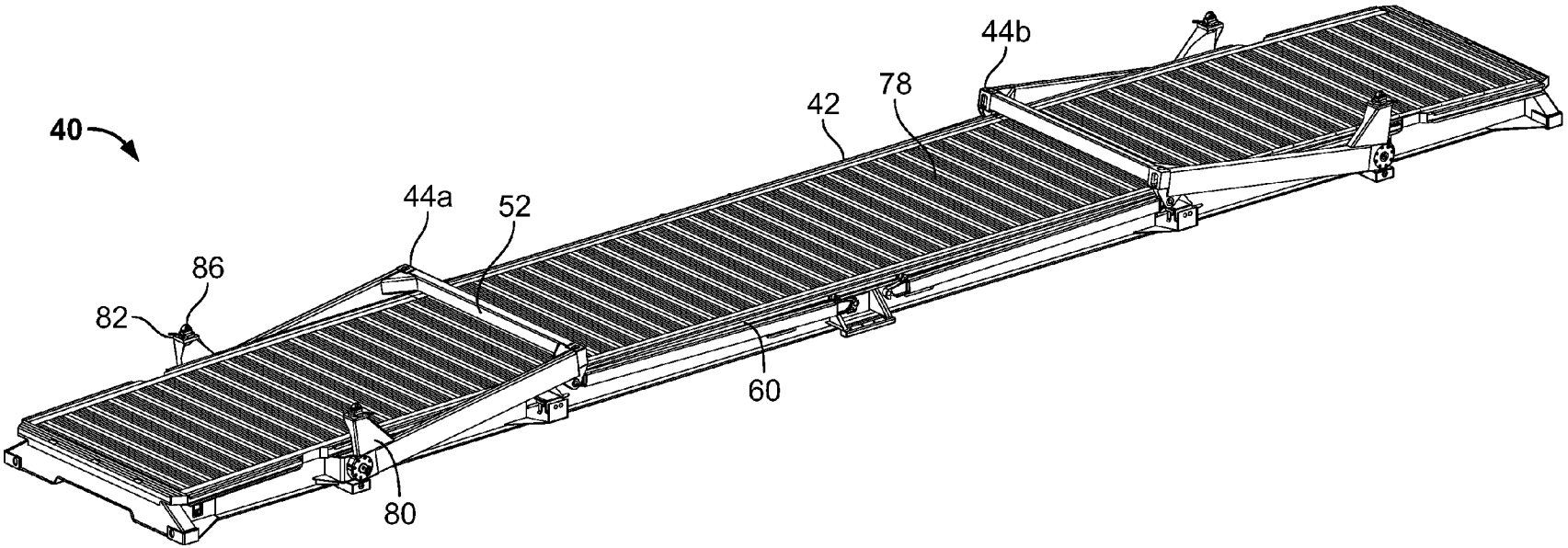
Figure 1C:
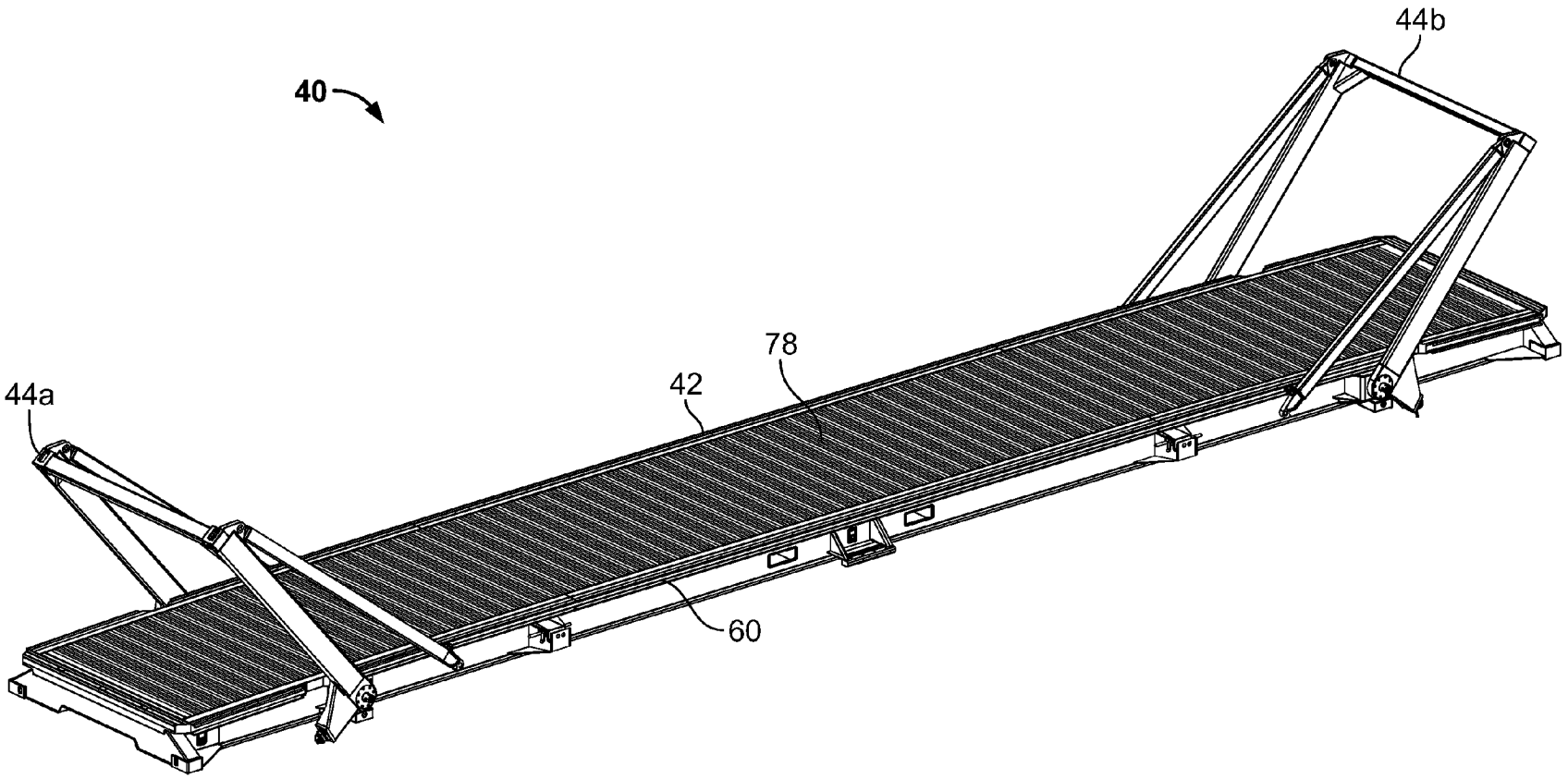

An embodiment of the collapsible intermodal flat rack of the present invention is indicated in general at 40 in FIGS. 1A-1C. As illustrated in FIG. 1A, the flat rack includes a cargo deck, indicated in general at 42 upon which are positioned arches, indicated in general at 44*a* and 44*b*. As will be explained in greater detail below, the arches are pivotally attached to the cargo deck. As illustrated for arch 44*a*, each arch includes a pair of upright posts 46 and 48 joined at the top in a rigid fashion by top cross member 52. A pair of support braces 54 and 56 are pivotally attached by their top ends to the arch 44*a*. The upright posts, top cross member and support braces are all preferably constructed from high strength steel, and the upright posts and top cross member preferably feature a hollow tube construction. As will be explained in greater detail below, the bottom ends of the support braces 54 and 56 travel in channels 60 and 62. Arch 44*b* is provided with similar support braces and construction.

The arches 44*a* and 44*b* may be moved between the positions shown in FIGS. 1A-1C to place the flat rack 40 in three configurations. More specifically, the arches may be positioned so that the flat rack is in a use or transport configuration, illustrated in FIG. 1A, a folded storage or stacking configuration illustrated in FIG. 1B and an expanded top loading configuration, illustrated in FIG. 1C.

The flat rack is placed in the use configuration of FIG. 1A when it is loaded with cargo and is to be transported by ship, truck or rail. As illustrated in FIG. 1A, the top of upright posts 46 and 48 are provided with lifting fitments 64 and 66, respectively, while arch 44*b* is provided with lifting fitments 67 and 69. In addition, arch 44*a* pivots about axis 68, while arch 44*b* pivots about axis 70. Pivot axis 68 is located 20 feet from the longitudinal midpoint 72 of the cargo deck 42 (the dimension indicated by arrow 74), while pivot axis 70 is located 20 feet from midpoint 72 (arrow 76) in the opposite direction. As a result, lifting fitments 64, 66, 67 and 69 are in the same position as the lifting fitments of a ISO class 1AA shipping container and may be handled by the same lifting and transport equipment.

The flat rack is placed in the storage configuration illustrated in FIG. 1B when it is no longer loaded with cargo and it is desirable that the flat rack take up as little room as possible for storage and stacking. As illustrated in FIG. 1B, the top cross member 52 of arch 44*a* and the top cross member of arch 44*b* rest on the top surface of the floor 78 of the cargo deck when the flat rack is in the storage configuration.

As illustrated in FIGS. 1A and 1B, arch 44*a* is provided with stacking blocks 80 and 82 positioned at the bottom of the uprights posts 46 and 48, respectively. The top of stacking block 80 is provide with a stacking pad 84, while the top of stacking block 82 is provided with stacking pad 86. The stacking pads may be flipped out of the way to expose lifting fitments underneath. Arch 44*b* is provided with similar stacking blocks. As illustrated in FIGS. 1A and 1B, when arches 44*a* and 44*b* are pivoted into the storage position, the stacking blocks automatically pivot up into a position where they may be used for stacking or lifting. With regard to the latter, the stacking blocks are positioned on the arches so that they are also 40 feet apart and thus correspond to the lifting fitment positions for ISO class 1AA shipping containers so that they may be handled by the same lifting and transport equipment.

Figure 2:
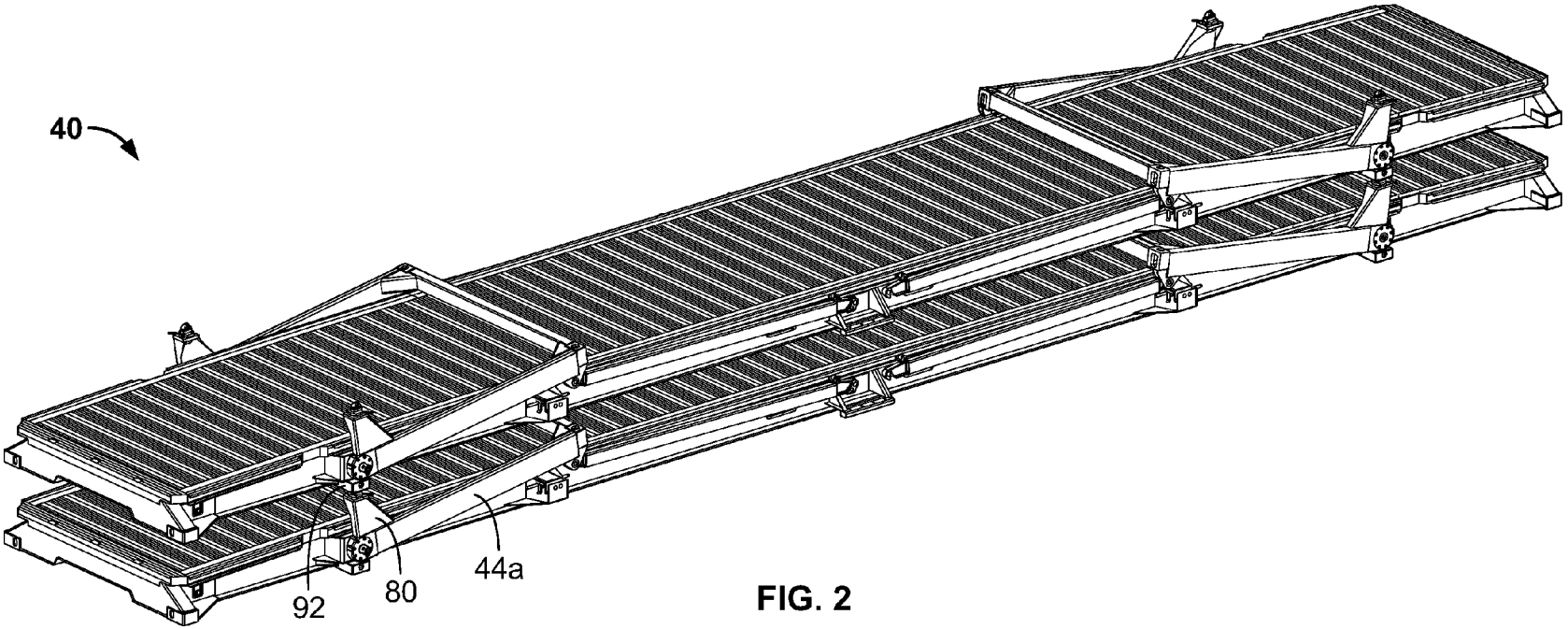
FIG. 2 is a perspective view of a number of flat racks of the type illustrated in FIGS. 1A-1C in a stacked configuration.
Figure 3:
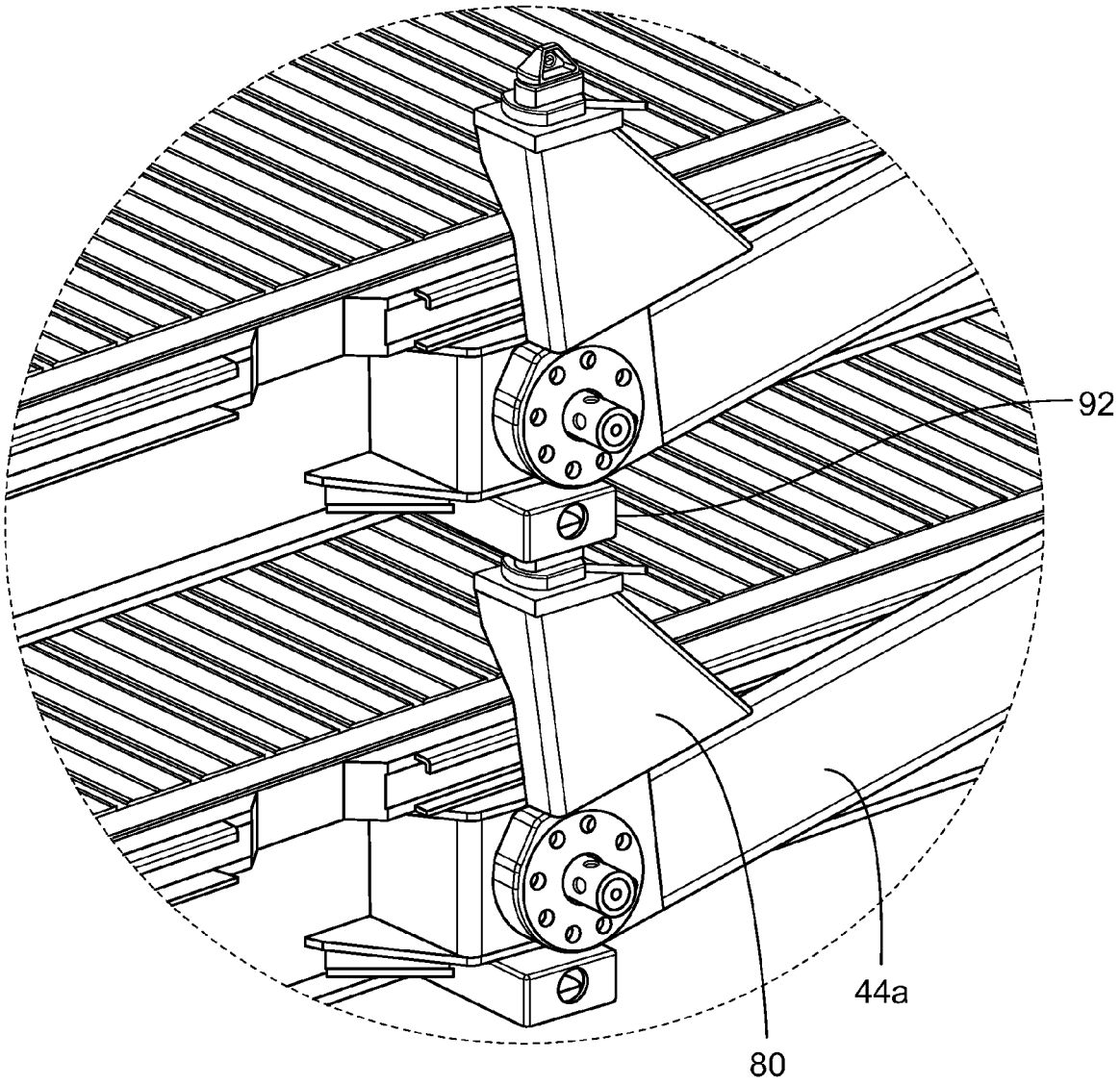
FIG. 3 is an enlarged perspective view of the stacking bocks and stacking supports of FIG. 2.

A number of stacked flat racks 40 are illustrated in FIGS. 2 and 3. As illustrated in FIGS. 2 and 3, stacking supports 92 are positioned under or adjacent to the cargo deck so as to be aligned with and engaged by a raised stacking block of a neighboring (above or below) flat rack.

With reference to FIG. 1C, the arches 44*a* and 44*b* may be tilted away from the longitudinal center of the flat rack so that cargo may be lowered from overhead, such as by a crane, and positioned on the floor 78 of the cargo deck 42. After such loading, the arches 44*a* and 44*b* may be returned to the use position of FIG. 1A.

Figure 4A:
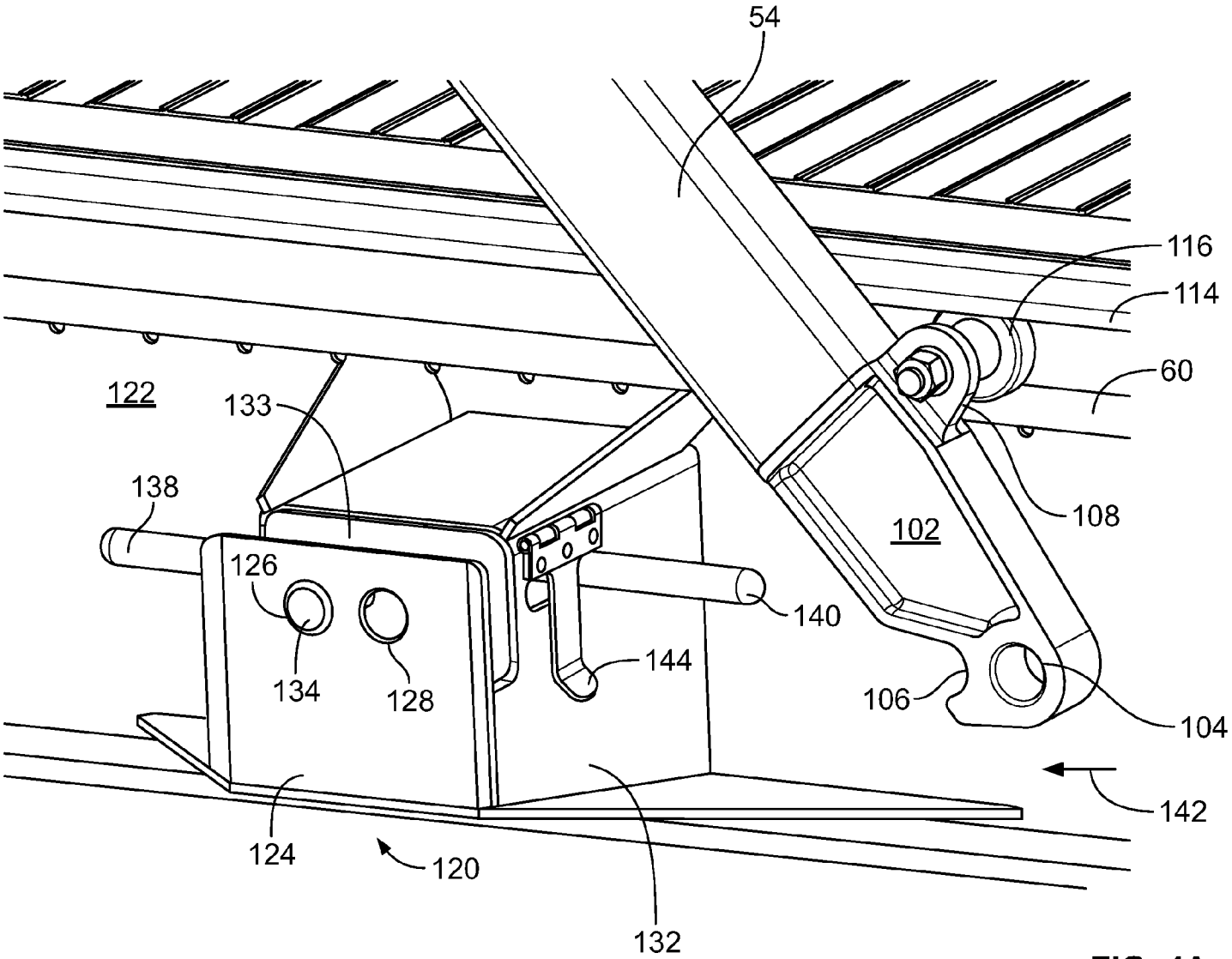
FIGS. 4A-4C are perspective views of an embodiment of the brace locking assembly of the present invention illustrating operation of the assembly.
Figure 5:
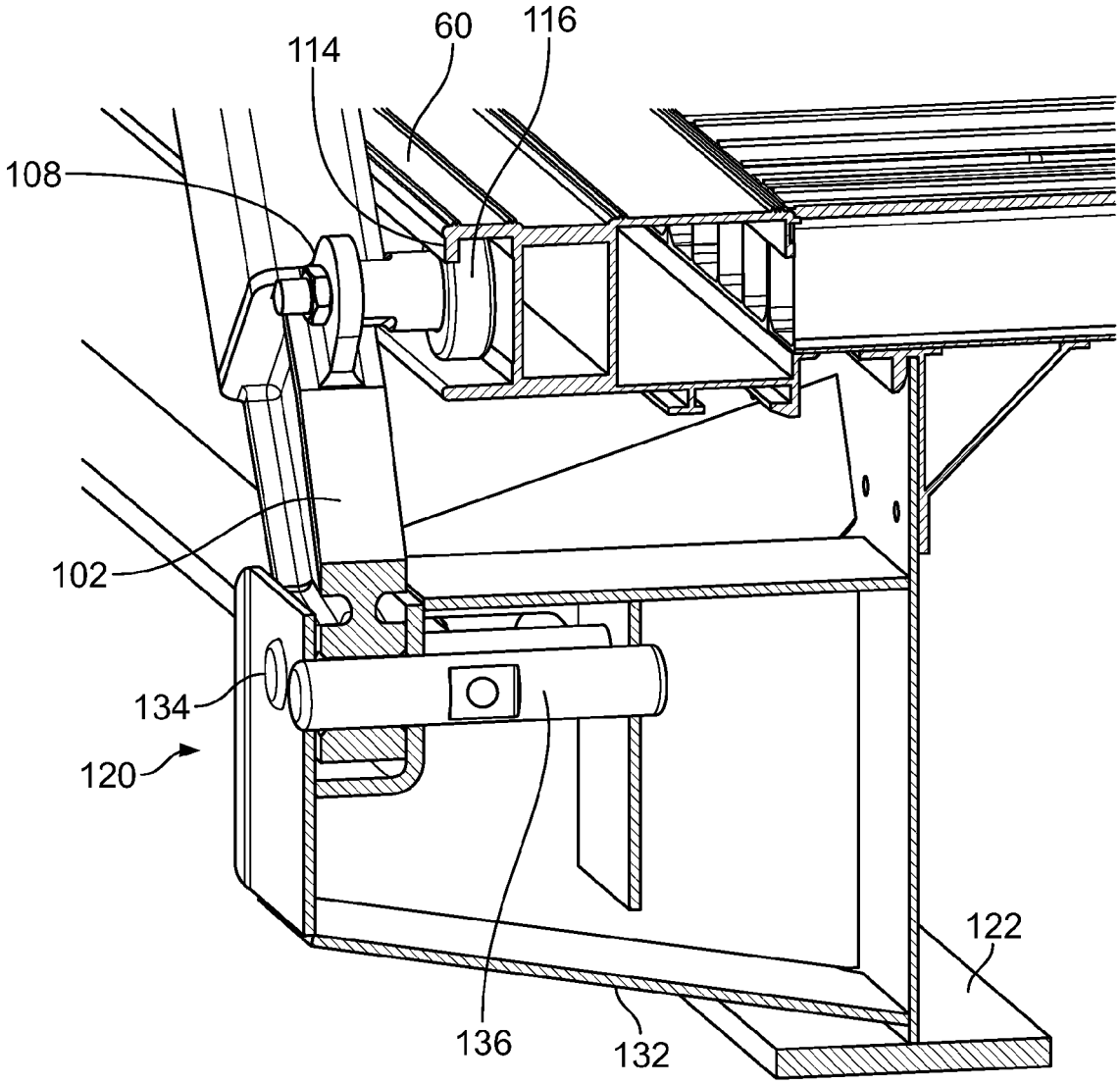
FIG. 5 is a cross sectional perspective view of the brace locking assembly of FIG. 4C.
Figure 6:
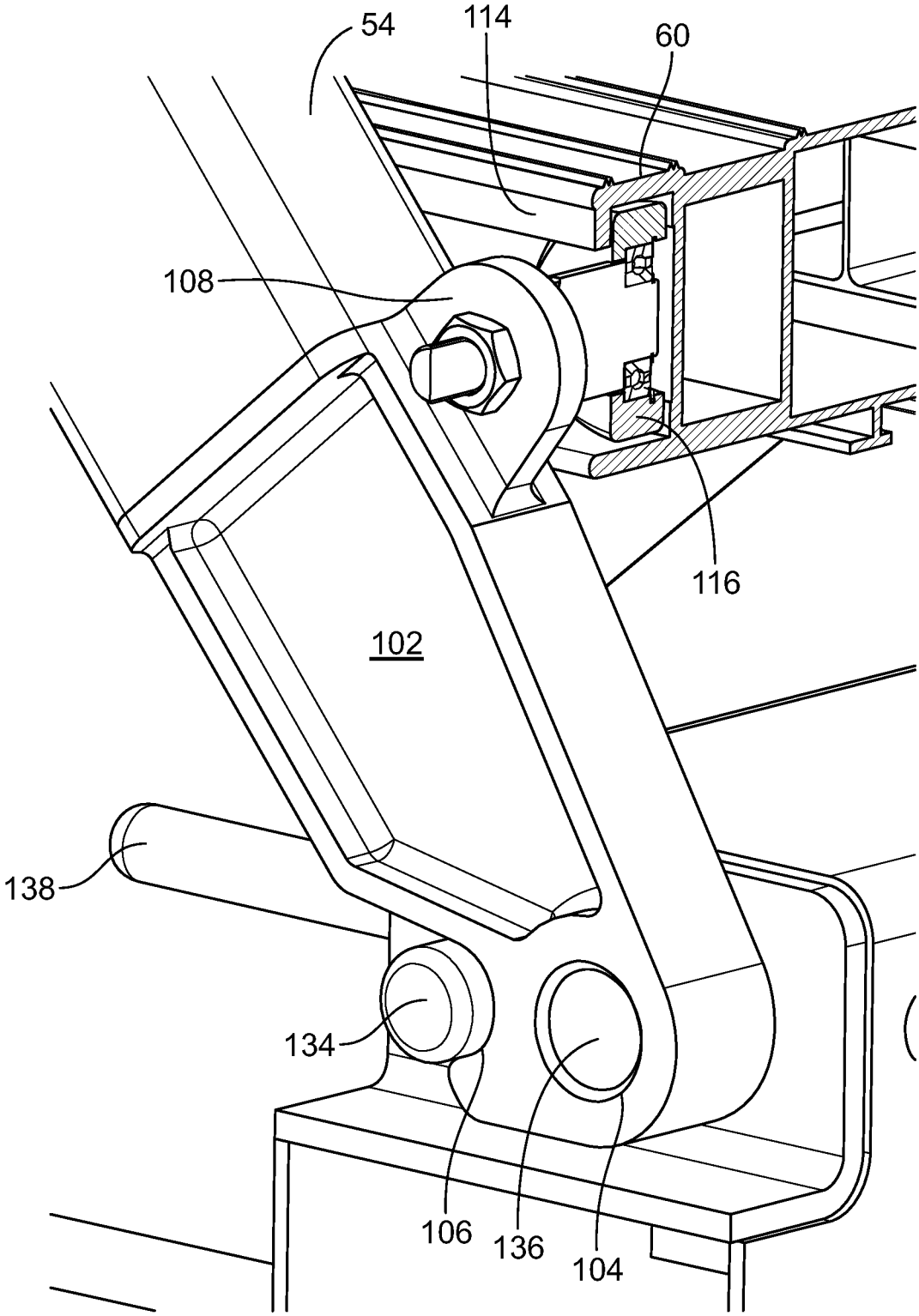
FIG. 6 is a perspective view of the brace locking assembly of FIG. 4C with the front plate removed.

As noted previously, with reference to FIG. 1A, the bottom ends of support braces 54 and 56 are movably mounted within channels positioned on the sides of the cargo deck 42. As illustrated in FIG. 4A, the bottom end of the support brace 54 is provided with a hook fitting 102 that includes a lock opening 104, a hook portion 106 and a roller tab 108. As illustrated in FIGS. 4A, 5 and 6, a generally C-shaped channel 60 is positioned on the side of the cargo deck 42 and features a downturned top lip 114. A roller 116 is rotationally attached to roller tab 108 and rolls within the channel 60. The top lip 114 keeps the roller 116 from traveling out of the channel 60.

As illustrated in FIGS. 1A-1G, the channel 60 runs nearly the entire length of the side of the cargo deck between the pivotal attachment locations of arches 44*a* and 44*b*. As a result the roller 316 stays within the channel as the arch 44*a* moves between the storage, use and expanded load positions. This ensures that the bottom ends of the support braces are secured during transport and storage of the flat rack. Support brace 56 (FIG. 1A) and the support braces of arch 44*b* operate in a similar manner.

As illustrated in FIG. 1A, the bottom end of support brace 54 is secured in brace locking assembly 120 when in the arch 44*a* is raised into the use position. The brace locking assembly is mounted on a main beam 122 of the cargo deck. Support brace 56 is provided with a similar brace locking assembly on the opposite side of the cargo deck (not visible), while the bottom ends of the support braces for arch 44*b* are also provided with similar brace locking assemblies.

An enlarged view of a brace locking assembly is provided in FIGS. 4A-5, where if is indicated in general at 120. The locking assembly includes a front plate 124 that includes pin openings 126 and 128. Mounted behind the front plate 124 is a pin housing 132. The pin housing is shaped so that a gap 133 is formed behind the front plate. The back side of the pin housing 132 is mounted to cargo deck main beam 122. As illustrated in FIG. 5, a stop pin 134 and a locking pin 136 are slidably mounted within the pin housing 132. As illustrated in FIG. 4A, the stop pin is provided with a handle 138 while the locking pin is provided with a handle 140. The pin housing 132 features elongated slots that accommodate the stop and locking pin handles as they protrude outside of the pin housing. As a result, they may be moved between extended positions, illustrated for both pins in FIG. 5, and retracted positions, illustrated for both pins in FIG. 7.

Figure 4B:
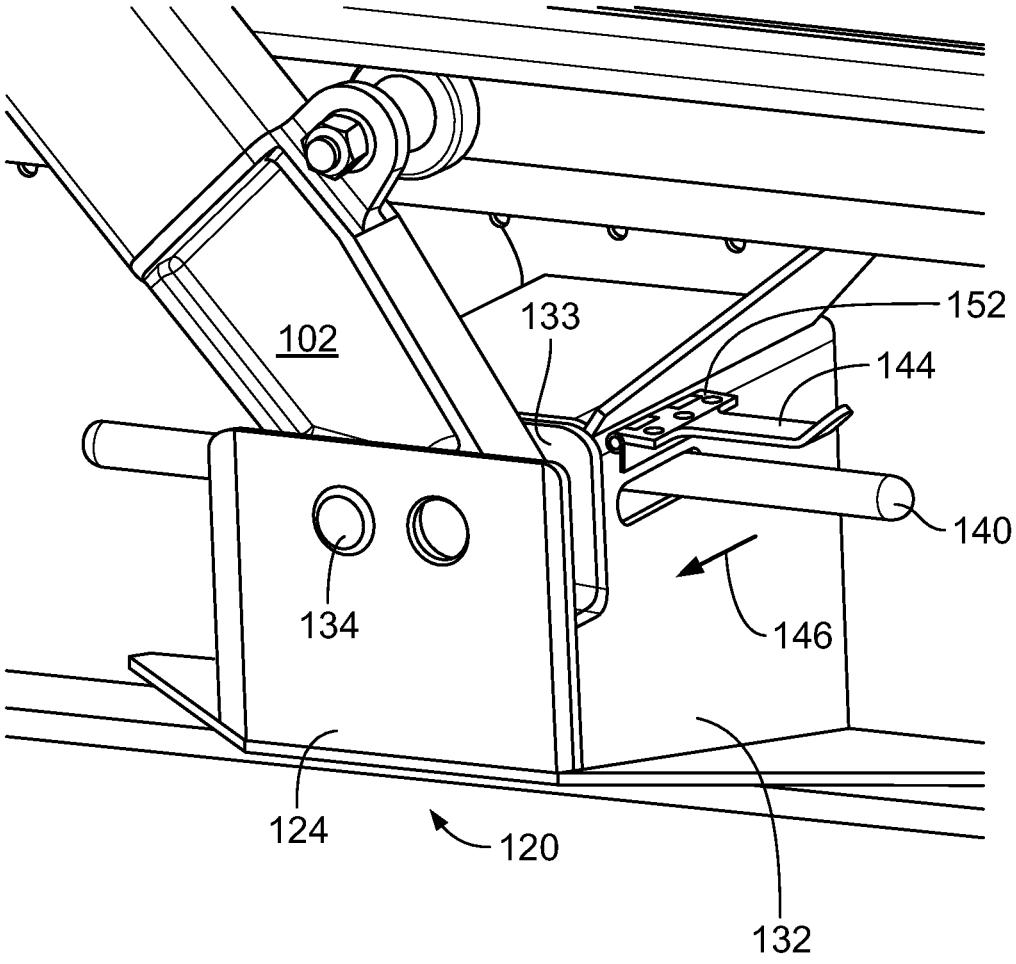
Figure 4C:
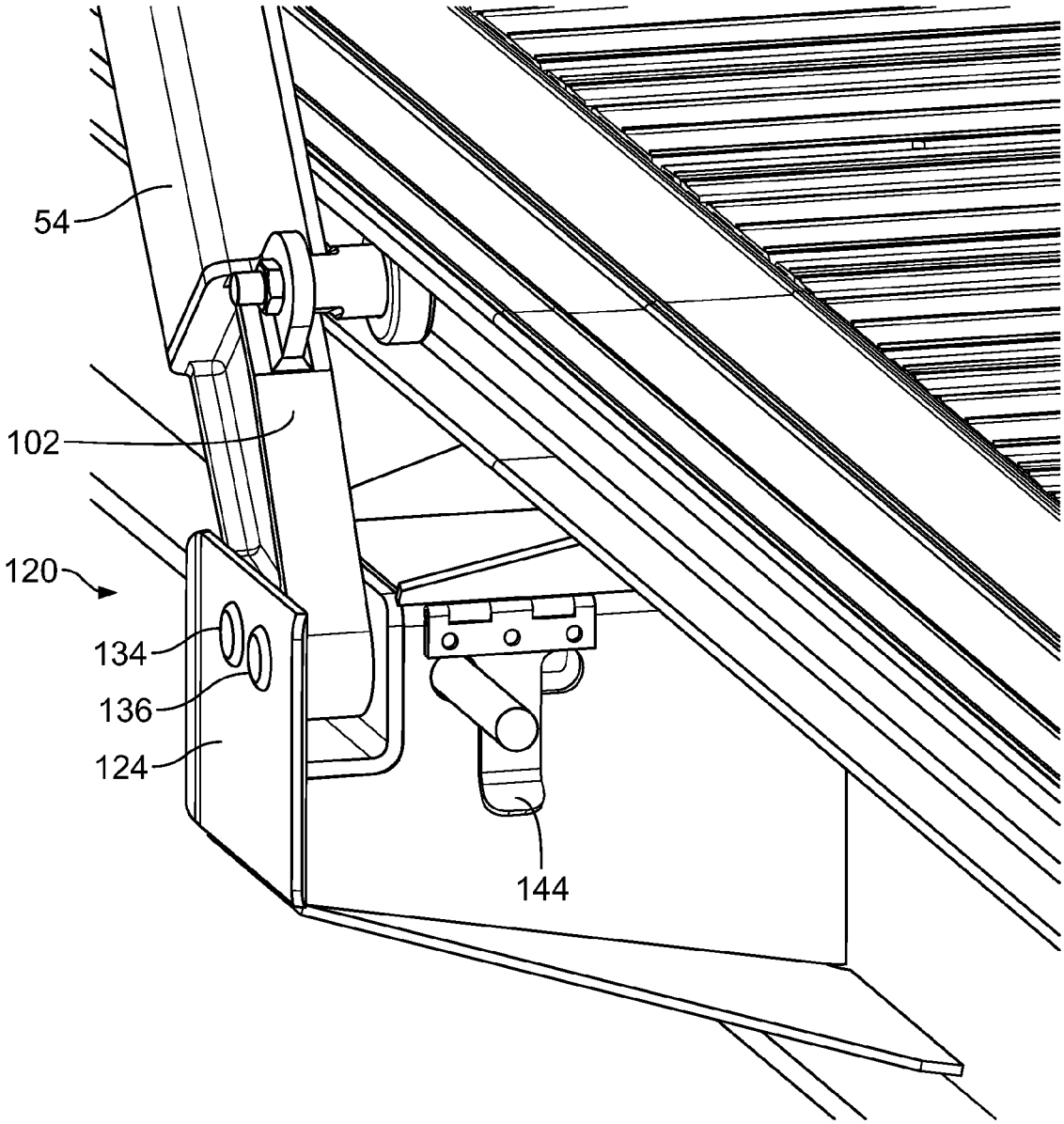

In use, when the arch 44*a* is moved from the storage position of FIG. 1B towards the use position illustrated in FIG. 1A, the hook fitting 102 of FIG. 4A travels toward the brace locking assembly 120, in the direction of arrow 142 (FIG. 4A). As illustrated in FIG. 4A, the locking assembly is configured with the locking pin retracted, and the stop pin 134 extended so that it passes through the pin opening 126 of the front plate 124. As illustrated in FIG. 4B, the hook portion of the hook fitting 102 travels into the slot 133 of the brace locking assembly and engages stop pin 134.

Next, as illustrated in FIG. 4B, lever 140 of the locking pin is pulled towards the front plate 124, as indicated by arrow 146. Before doing so, however, a pin lock 144 that is attached by its top end to the side of the pin housing 132 by a hinge 152 is raised so that the handle 140 may pass under it. As illustrated in FIGS. 4C-6, the locking pin 136 then passes through the lock opening 104 of the hook fitting 102. The pin lock 144 is then lowered into the position shown in FIG. 4C. As a result, the lower end of the support brace 54 is locked in the position illustrated in FIG. 1A.

Figure 7:
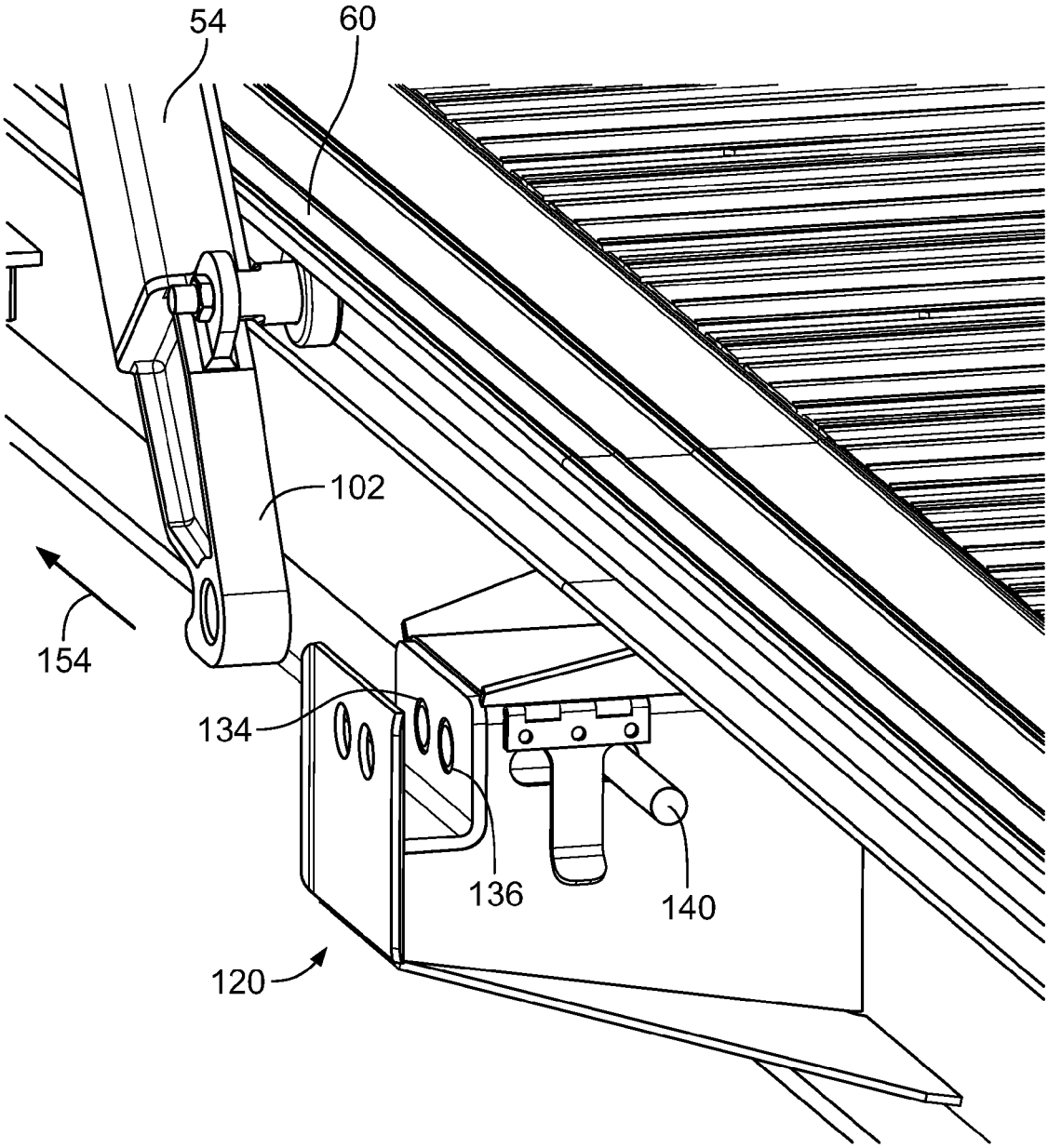
FIG. 7 is a perspective view of the brace locking assembly of FIGS. 4A-6 illustrating further operation of the assembly.

When it is desired to move arch 44*a* into the extended load position of FIG. 1C, the stop pin 134 is moved into the retracted position illustrated in FIG. 7 via stop pin handle 138. The handle 138 of the stop pin 134 is provided with a pin lock similar to pin lock 144 of the locking pin handle 140. As a result, this pin lock must be raised and lowered as the handle 138 is moved from the stop pin extended position to the stop pin retracted position in the manner described above for the locking pin handle 140. The locking pin 136 is also retracted via handle 340. With the hook fitting 102 released from the brace locking assembly 120, the support brace may travel towards the end of the flat rack, in the direction of arrow 154 in FIG. 7.

Figure 8:
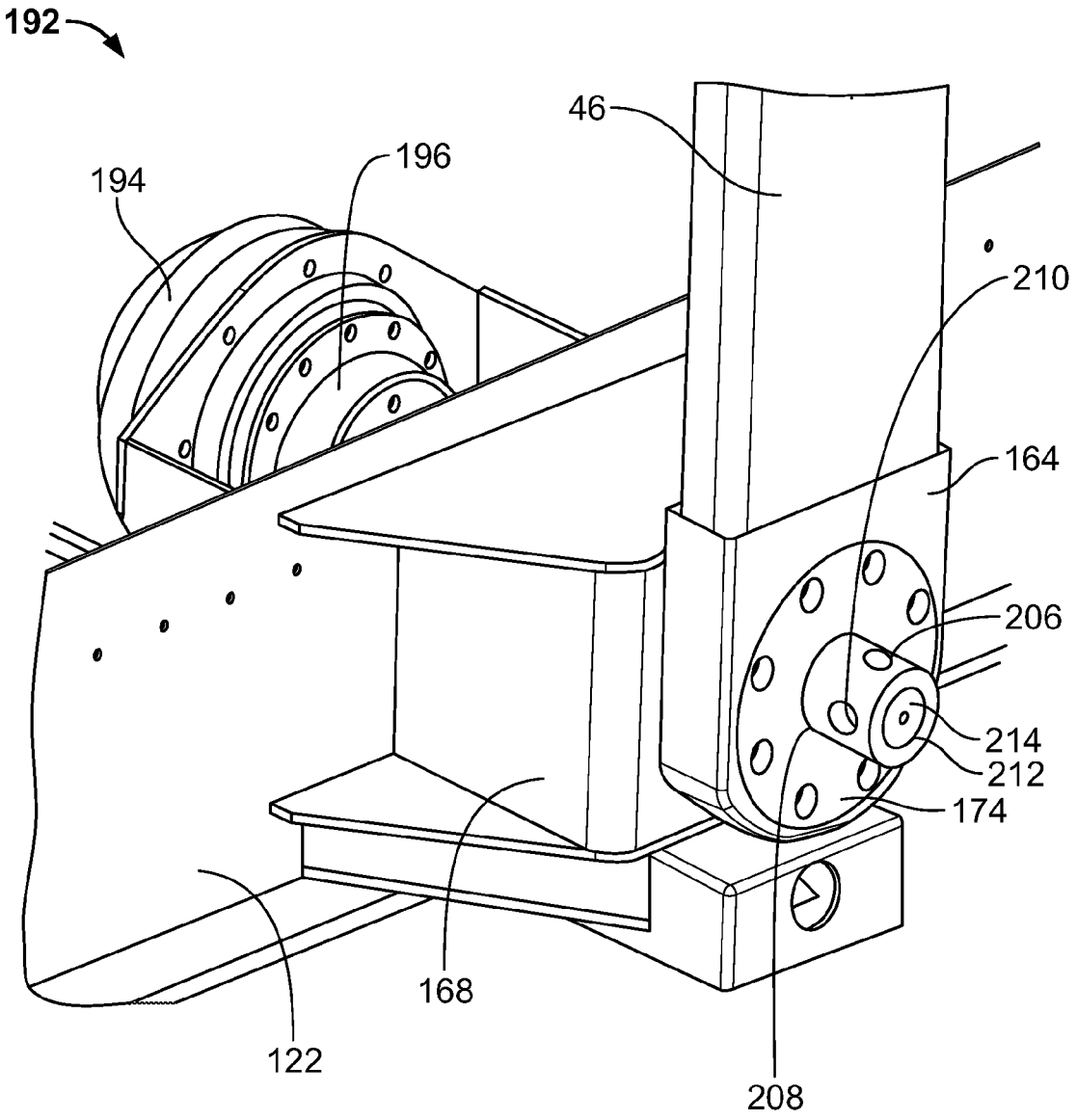
FIG. 8 is a front perspective view of an embodiment of the crank mechanism of the present invention with the cargo deck floor removed.

As illustrated in FIG. 8, a sleeve 164 (also illustrated in FIGS. 1A and 9) receives the bottom end of upright post 46.

As also illustrated in FIG. 8, a bearing box 168 is secured to the outer side surface of main beam 122 of the cargo deck. As illustrated in FIGS. 10A and 10B, the bearing box 168 is positioned under the floor 78 of the cargo deck and under channel 60. The bearing box houses and supports in a fixed fashion an outer bearing tube 172 (FIGS. 9, 10A and 10B), which is also connected to main beam 122. An inner bearing tube 174 is secured to the sleeve 164 in a fixed manner. The inner bearing tube 174 is received within the outer bearing tube so that the that the upright post 46 is supported by its bottom end to the cargo deck in a pivoting fashion.

Figure 11:
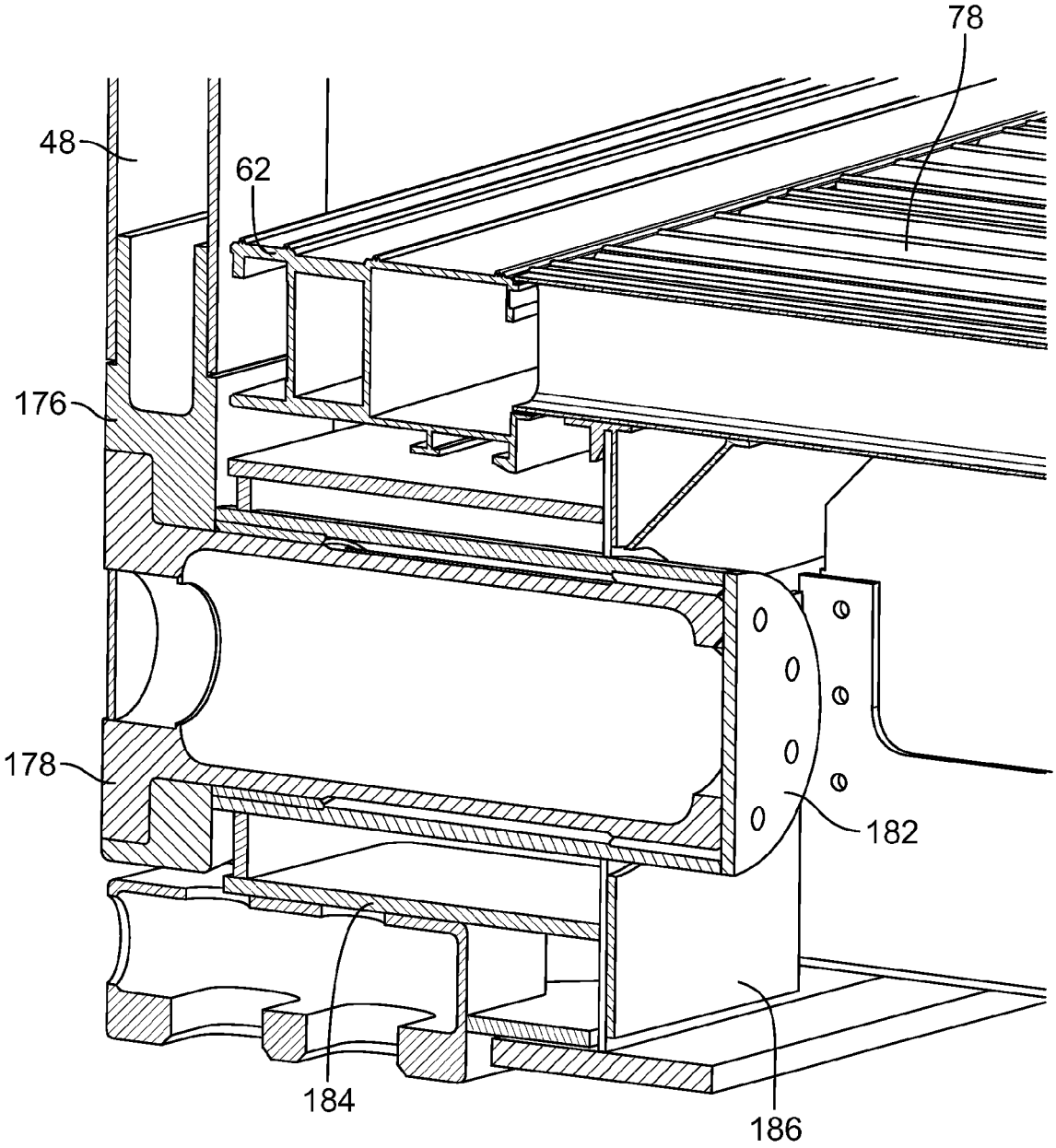
FIG. 11 is a cross sectional perspective view of an embodiment of an arch bearing assembly on a side of the arch opposite a side featuring a crank mechanism.

Upright post 48 (FIG. 1A) also features a bottom end that is received within a sleeve 176, as illustrated in FIG. 11. An inner bearing tube 178 is attached to the sleeve 176 in a fixed fashion. An outer bearing tube 182 is housed and supported in a fixed fashion within a bearing box 184. The bearing box 184 is attached to a second main beam member 186 of the cargo deck (discussed in greater detail below) and is positioned under the floor 78 of the cargo deck and a channel 62 that receives a roller mounted on the bottom end of support brace 56 of FIG. 1A (in the same manner as channel 60 for support brace 54). As a result, upright post 48 is supported by its bottom end to the cargo deck in a pivoting fashion.

Figure 9:
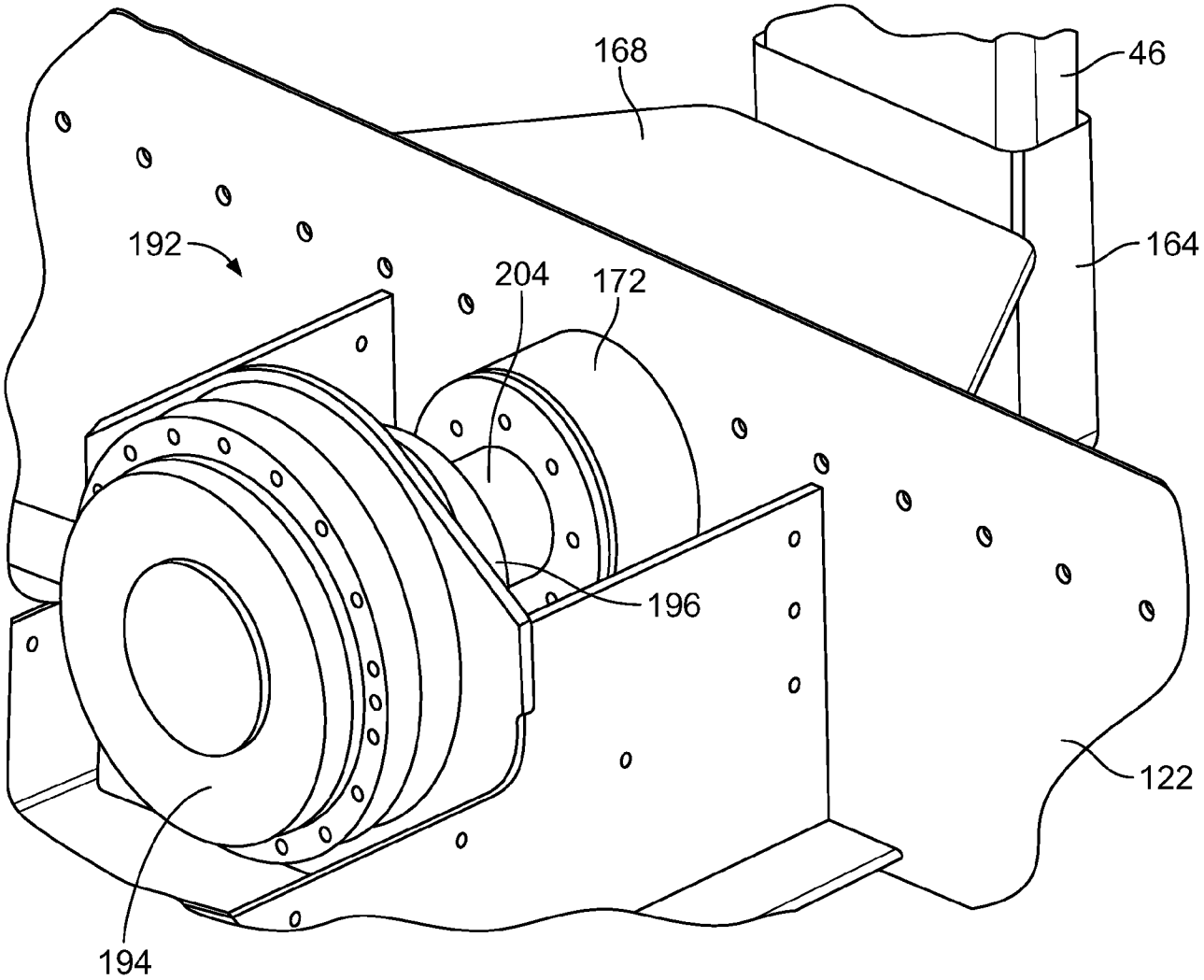
FIG. 9 is a rear perspective view of the crank mechanism of FIG. 8.
Figure 10A:
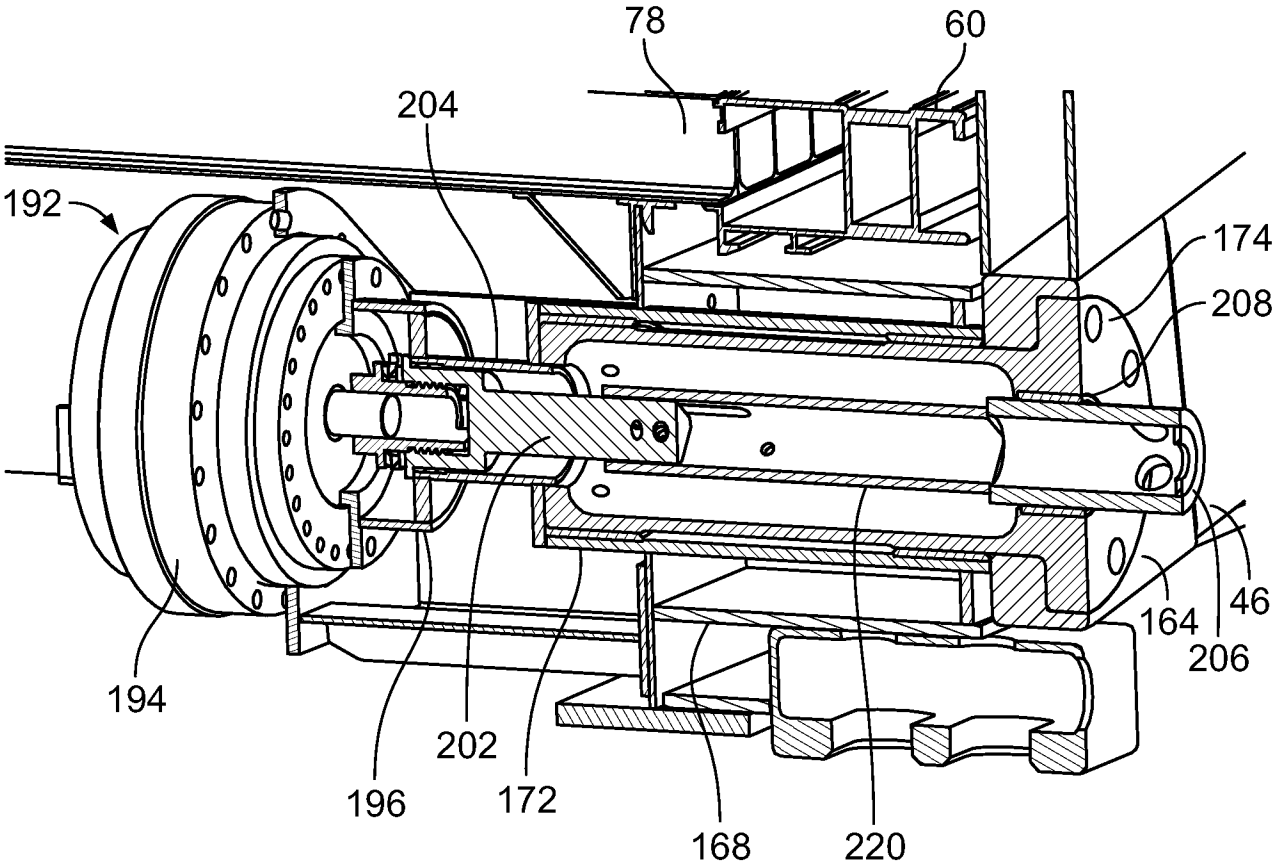
FIGS. 10A and 10B are cross sectional perspective views of the crank mechanism of FIGS. 8 and 9 with the fitment in extended and retracted positions, respectively.
Figure 10B:
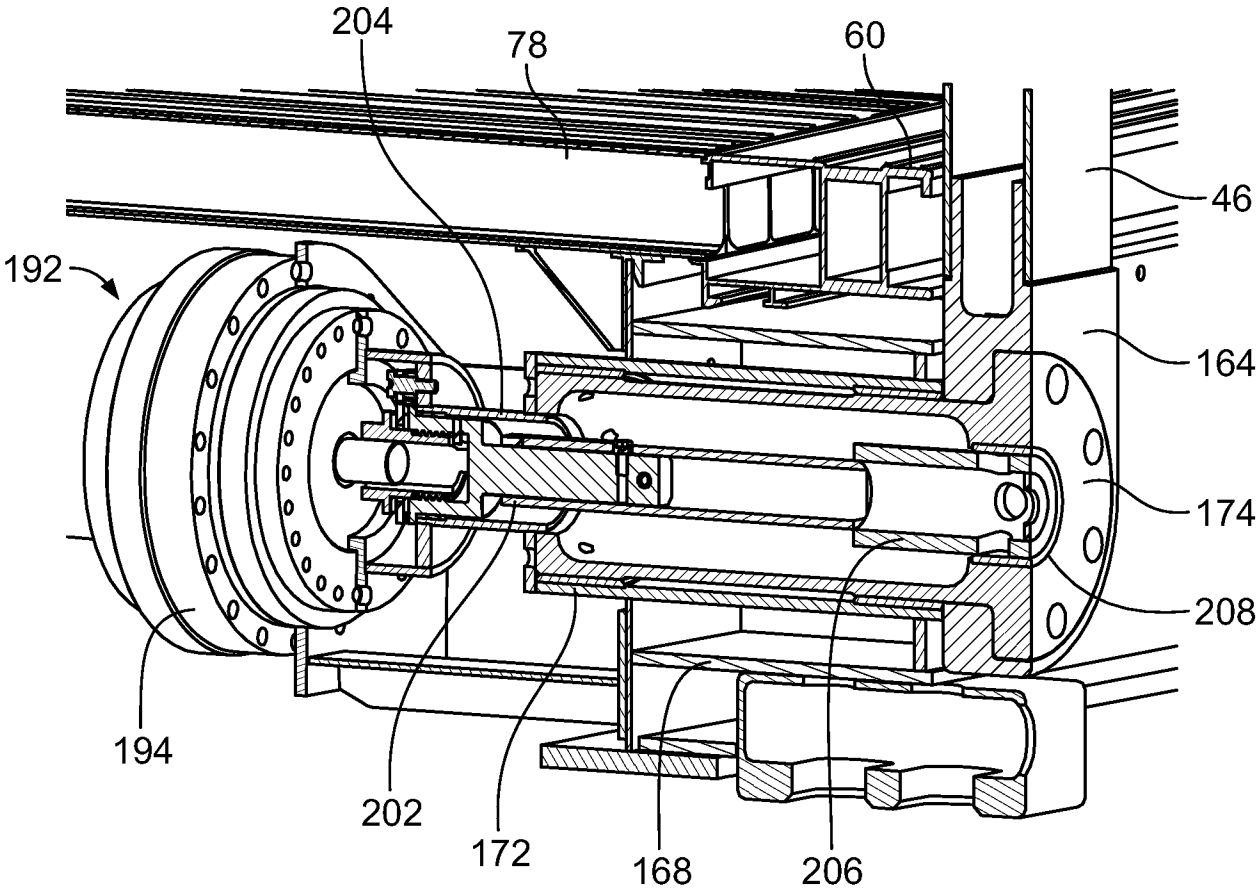

A crank mechanism for raising and lowering arch 44*a* (FIG. 1A) so that it may be moved between the use, storage and extended load positions illustrated in FIGS. 1A-1C is indicated in general at 192 in FIGS. 8 and 9. Arch 44*b* is provided with a similar mechanism. As illustrated in FIGS. 8, 9, 10A and 10B, the crank mechanism includes a gearbox 194, a brake 196, a gearbox input shaft 202 and a tubular gearbox output shaft 204. These components are positioned under the floor of the cargo deck so that they are protected from weather and damage.

As illustrated in FIGS. 9, 10A and 10B, the gearbox output shaft 204 passes through an opening formed through the end wall of the outer hearing tube 172 and is secured to the inner bearing tube 174.

The crank mechanism 192 also includes a crank mechanism fitment 206, showed with the fitment 206 in the extended position in FIGS. 8 and 10A, and in the retracted position in FIG. 10B. The fitment passes through an opening 208 formed in the middle of the inner hearing tube 174.

Figure 12A:
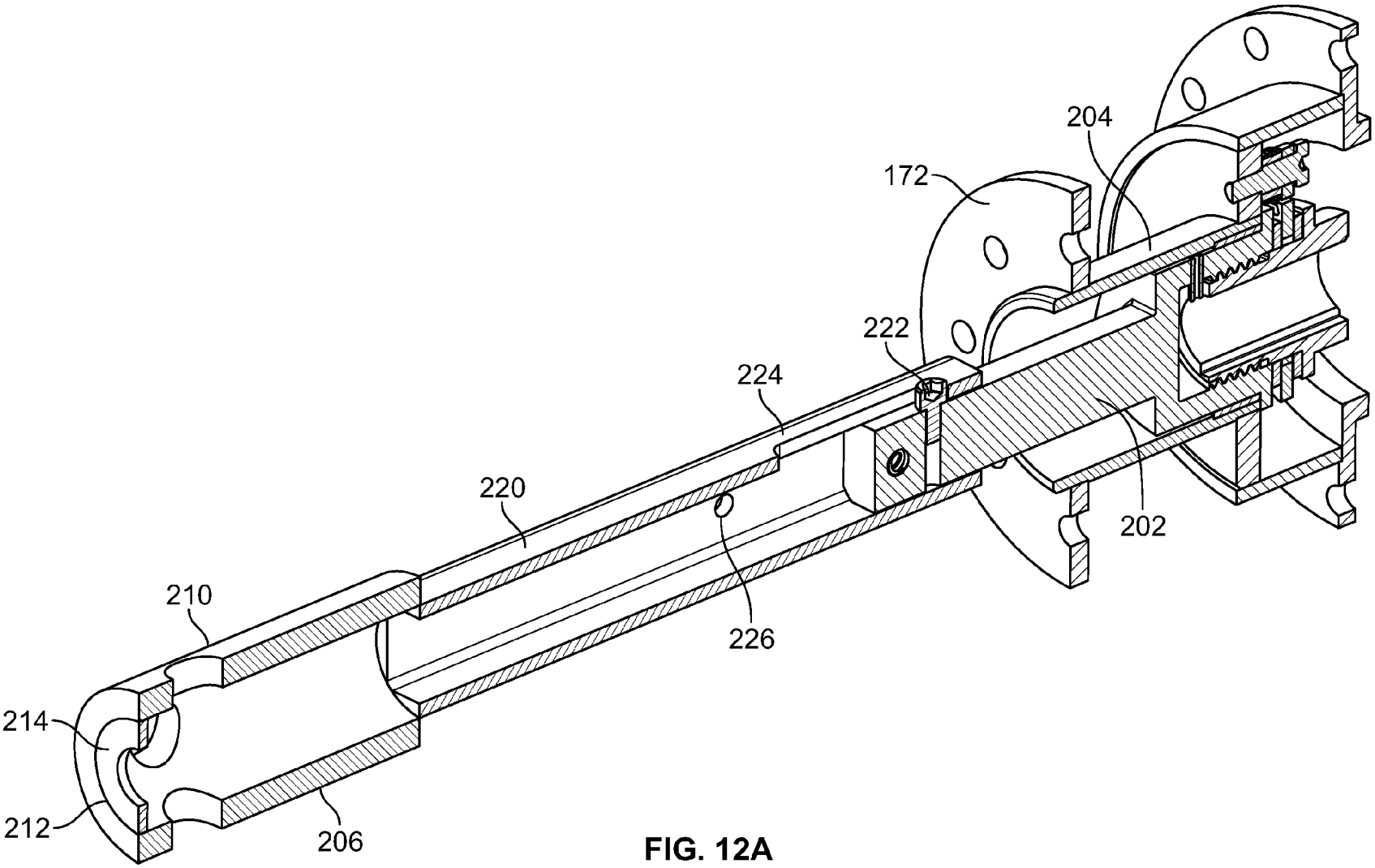
FIGS. 12A and 12B are cross sectional perspective views of the crank mechanism telescoping fitment assembly with the fitment in extended and retracted positions, respectively.
Figure 12B:
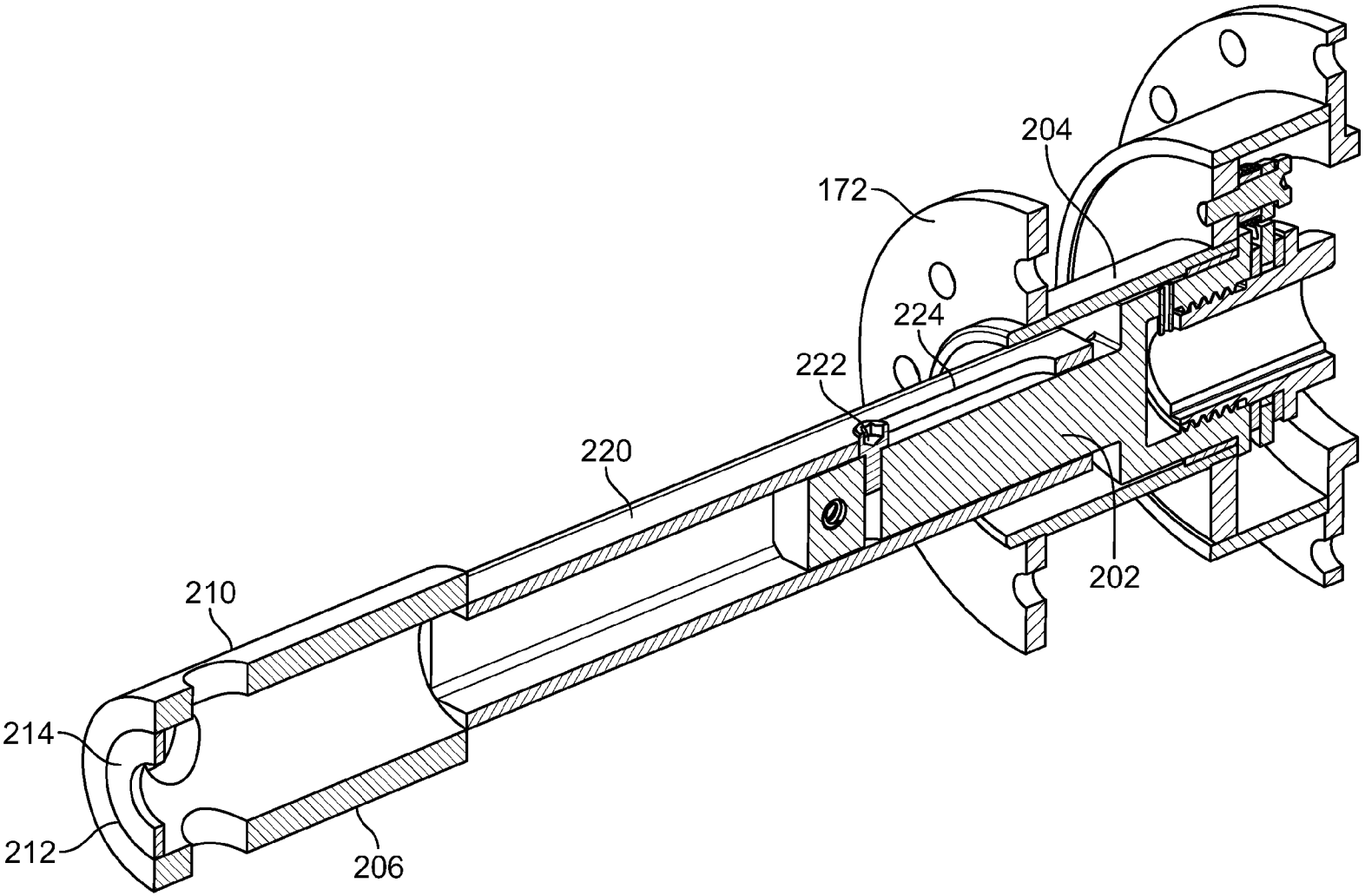

Enlarged views of the telescoping fitment are provided in FIGS. 12A, 12B, 13A and 13B. The crank mechanism fitment 206 is provided with tool holes 210. As illustrated in FIGS. 12A and 12B, the fitment also includes an end opening 212 provided with an annular flange 214. The crank mechanism fitment 206 is mounted to the end of a telescoping arm 220 which is tubular and preferably features a square cross section. The gearbox input shaft 202 has a square cross section and is sized to be received in a sliding fashion within the telescoping arm 220. A guide pin 222 is secured to the input shaft 202 and is received within a guide slot 224 formed within the telescoping arm 220. As a result, the guide pin traverses the guide slot 224 as the fitment 206, and thus telescoping arm 220, are moved between the extended position illustrated in FIG. 12A (corresponding to FIGS. 8 and 10A) and the retracted position illustrated in FIG. 12B (corresponding to FIG. 10B).

Figure 13A:
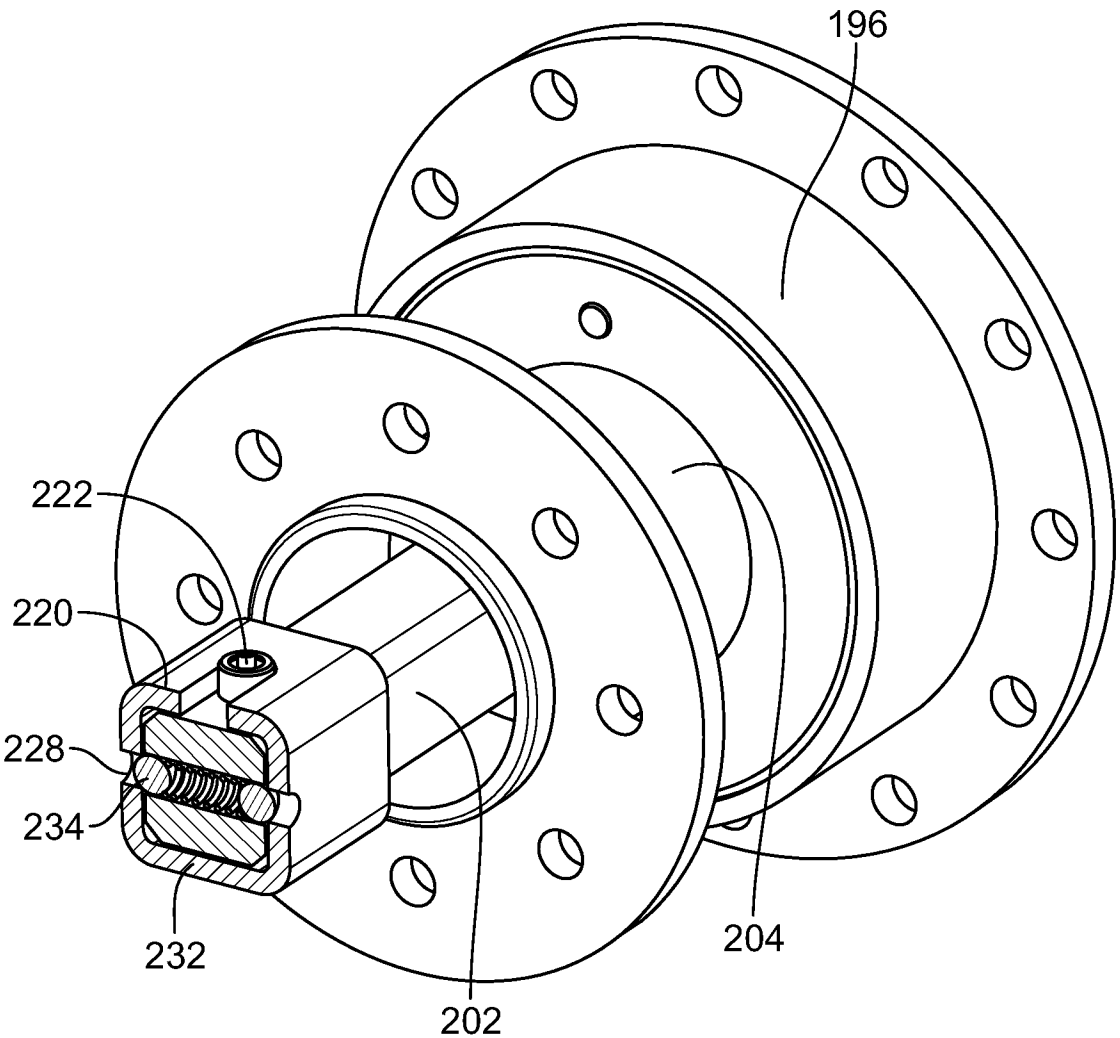
FIGS. 13A and 13B are enlarged cross sectional perspective views of the proximal end of the telescoping arm and related components of FIGS. 12A and 12B, respectively.
Figure 13B:
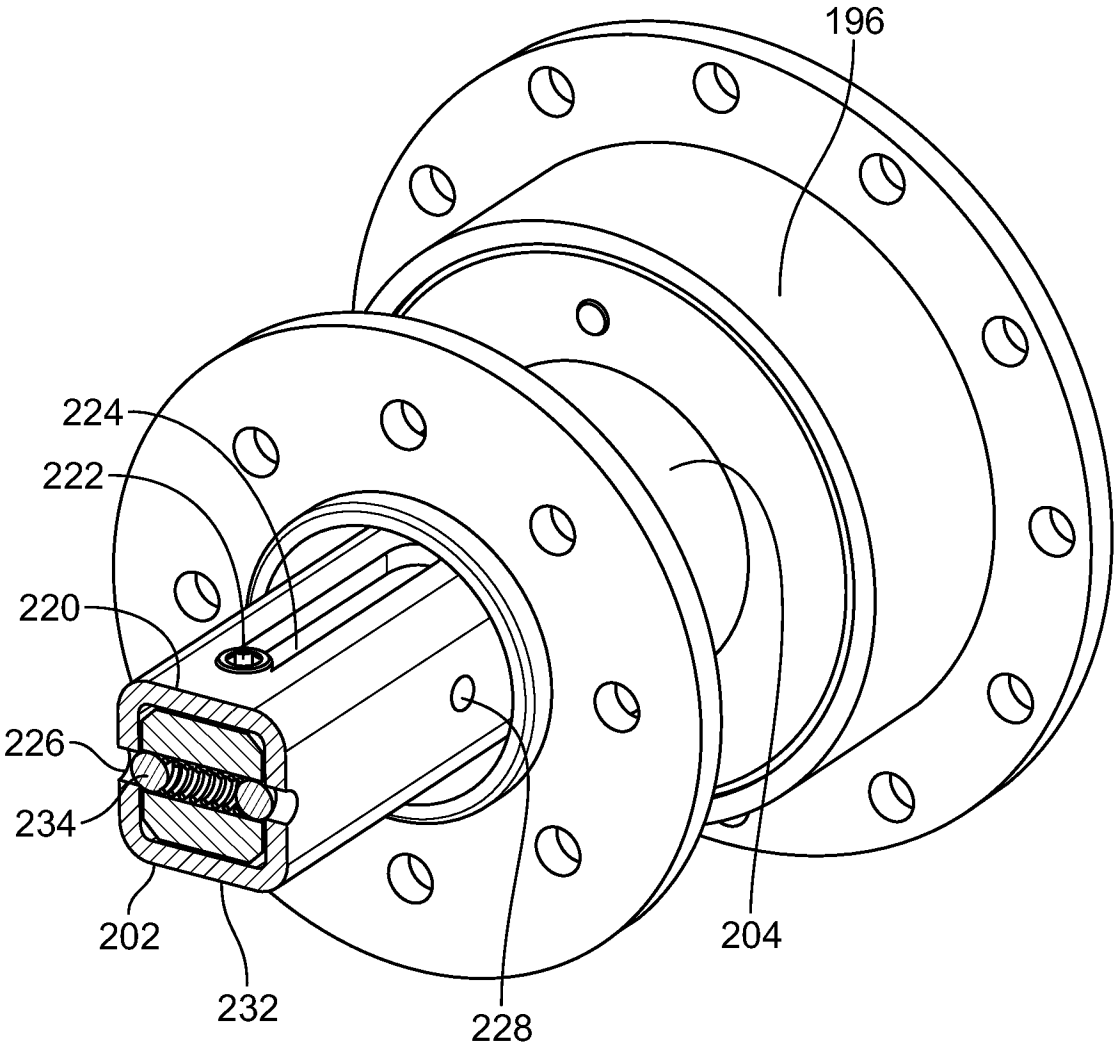

As illustrated in FIGS. 12A and 13B, the telescoping arm 220 has a pair of retracted position locking holes 226 and, as illustrated in FIGS. 13A and 13B, a pair of extended position locking holes 228. As illustrated in FIGS. 13A and 13B, the gearbox input shaft 202 includes bore within which is position a spring 232 and a pair of spring balls 234. The spring is a compression spring and thus urges the spring balls outward. As illustrated in FIG. 13A, when the fitment and the telescoping arm are in the extended position (FIG. 12A), the spring balls 234 engage extended position locking holes 228 of the telescoping arm 220 to secure the fitment 206 in the extended position illustrated in FIGS. 8 and 10A. Conversely, as illustrated in FIG. 13B, when the fitment and telescoping arm are in the retracted position (FIG. 12B), the spring balls 234 engage retracted position locking holes 226 of the telescoping arm 220 to secure the fitment 206 in the retracted position (FIG. 10B).

Figure 14:
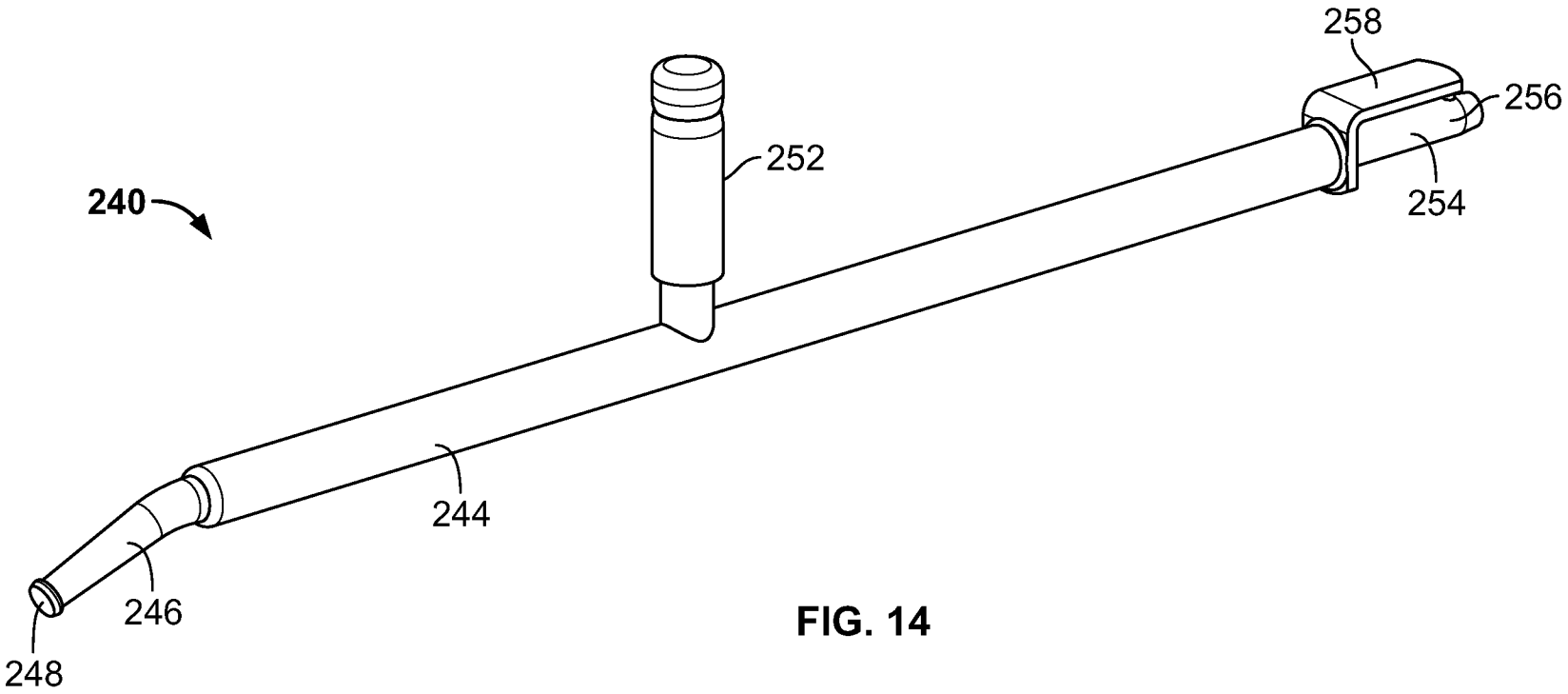
FIG. 14 is a perspective view of a tool specifically adapted for operation of the cranking mechanism of FIGS. 8-13B.

The operation of the crank mechanism of FIGS. 8-13B for raising and lowering the arch 44*a* (FIG. 1A) will now be explained with reference to FIGS. 14-16C. While a number of alternative tools may be used to operate the crank mechanism, including a conventional winch bar, a tool specifically adapted for use with the mechanism, such as the one indicated in general at 240 in FIG. 14 is preferred. As illustrated in FIG. 14, the tool includes an elongated body 244 having an angled pick 246 with a tapered diameter at a first end. A circumferential bead 248 is formed around the tip of the pick, the purpose of which will be explained below. A handle 252 is attached to the elongated body 244 in a generally perpendicular fashion. A reduced diameter portion 254 is positioned on a second end of the tool and is provided with a spring ball 256 (having a construction similar to the spring ball 234 and spring 232 of FIGS. 13A and 13B, but only with one spring ball 256). An angled guide 258 is also attached to the second end of the tool and passes over the reduced diameter portion 254.

Figure 15A:
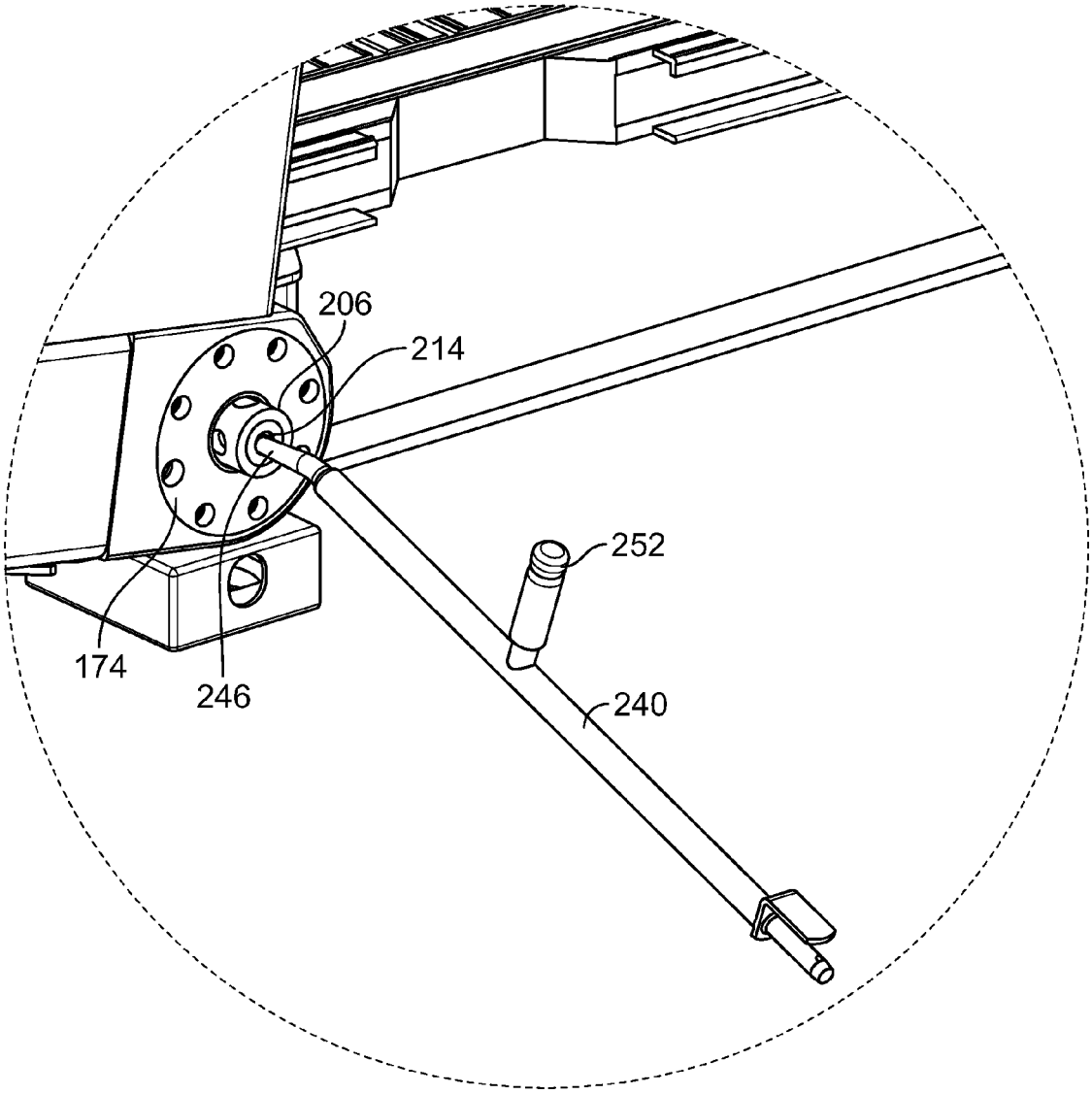
FIGS. 15A and 15B are perspective views illustrating use of the tool of FIG. 14.

As illustrated in FIG. 15A, the fitment 206 is pulled out from the retracted stored position within the inner bearing tube 174 by inserting the pick end 246 of the tool 240 into the open end of the fitment and engaging the annular flange 214 with circumferential bead 248 (FIG. 14). The fitment is then pulled out into the extended position for use in actuating the mechanism (192 of FIGS. 8-10B).

Figure 15B:
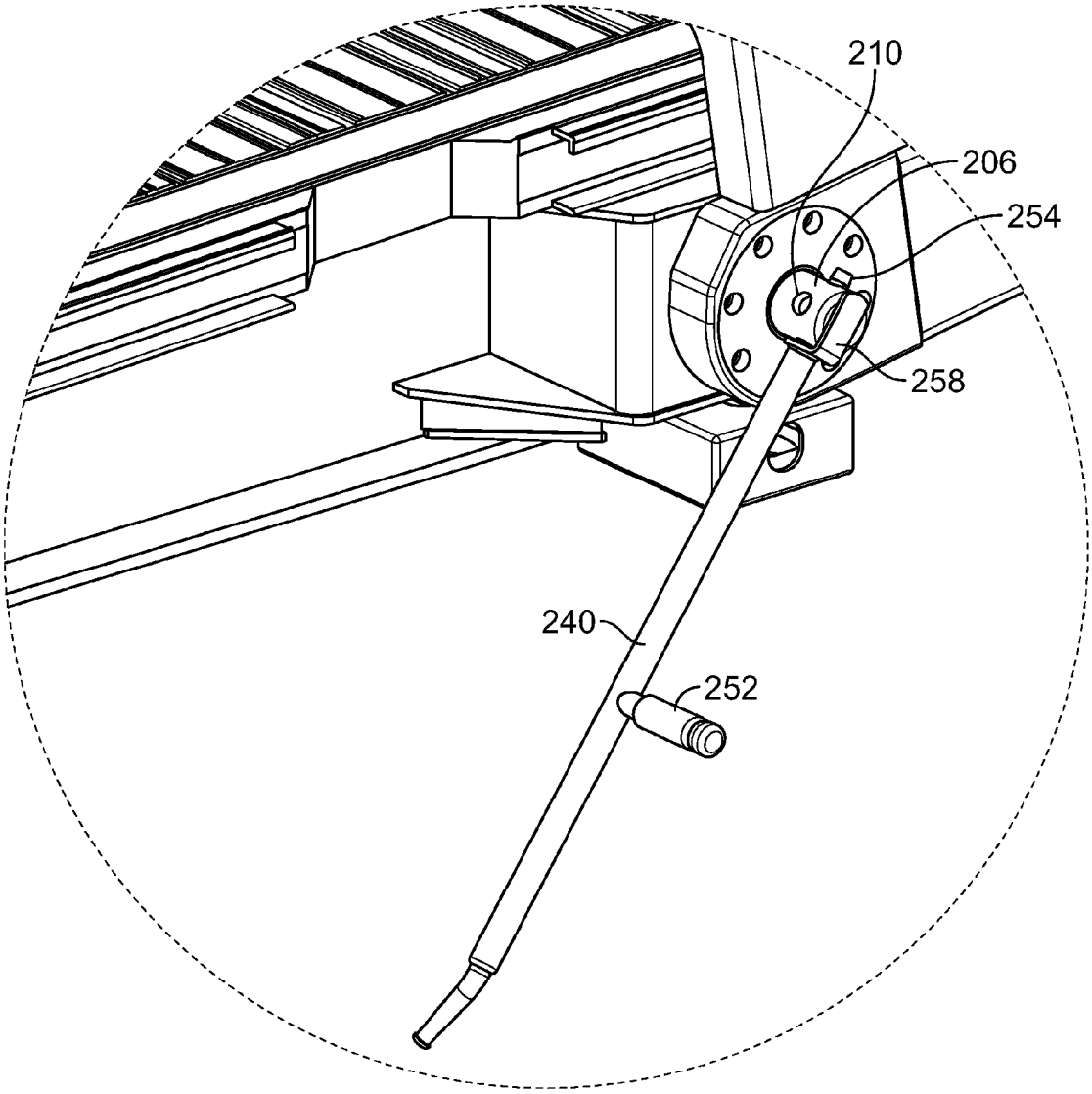

Next, as illustrated, in FIG. 15B, the reduced diameter portion 254 on the second end of the tool 240 is inserted into a corresponding pair of the tool holes 210 of fitment 206. The spring ball 256 (FIG. 14) and the angled guide 258 ensure that the tool remains engaged with the fitment as the tool, and thus the fitment, are turned via handle 252. In addition, the angled guide ensures that the handle 252 of the tool remains pointed outwards to facilitate turning the crank mechanism.

Figure 16A:
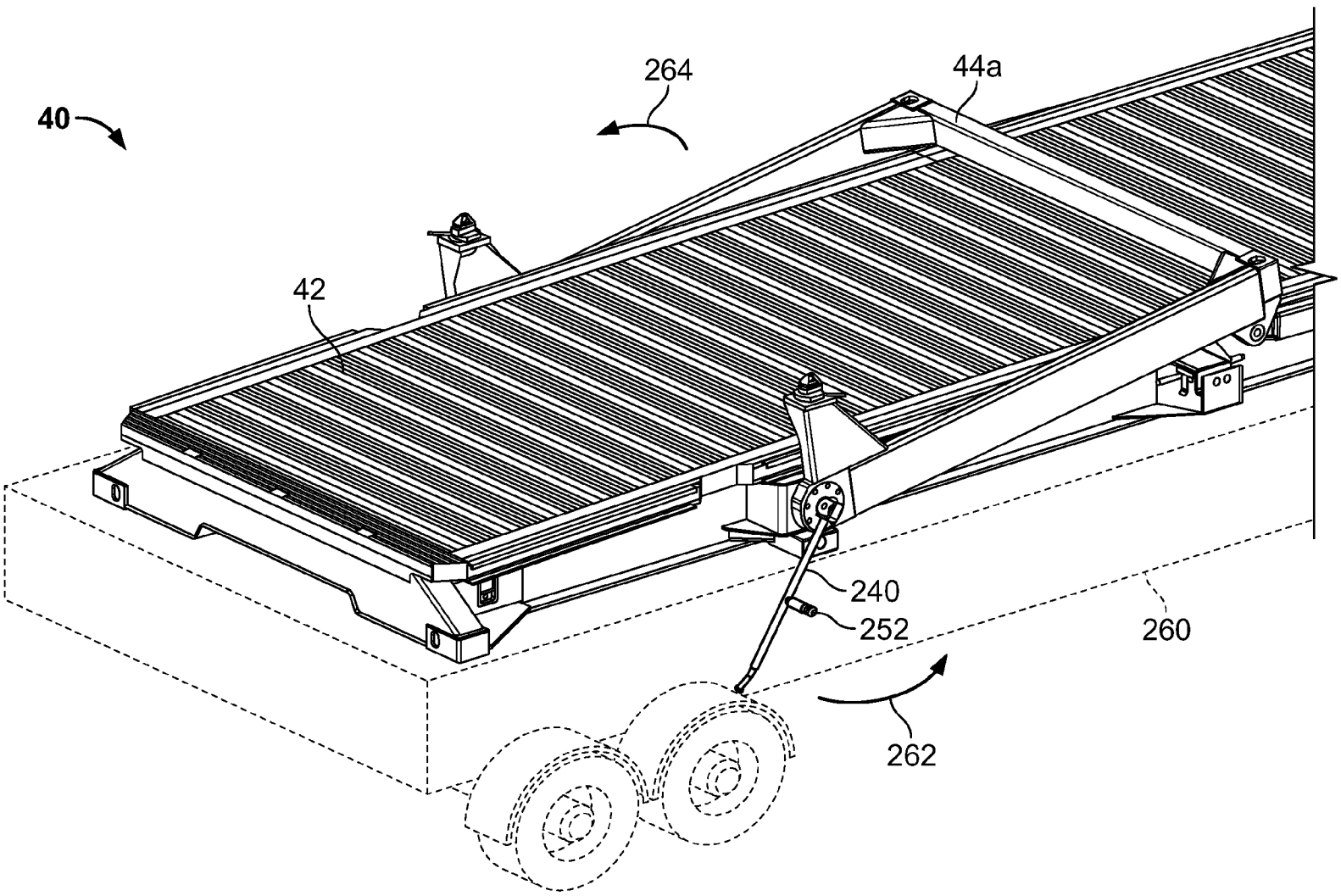
FIGS. 16A-16C illustrate use of the cranking mechanism of FIGS. 8-13B and the tool of FIG. 14.

With reference to FIG. 16A, the flat rack 40, in the storage configuration, is positioned on a railcar or a trailer of a semi-trailer truck, indicated in phantom at 260. A user then grasps the handle 252 of the tool 240 and rotates it in the direction of arrow 262.

With reference to FIGS. 10A and 12A, this causes the fitment 206, the telescoping arm 220 and the gearbox input shaft 202 to turn as a unit. The gearbox 194 (FIGS. 9 and 10A) then transfers the rotational force, with a mechanical advantage, to the gearbox output shaft 204, which in turn pivots inner bearing tube 174 and upright post 46 via sleeve 164. As a result, the arch 44*a* rises as indicated by arrow 264 (FIG. 16A) into the use position illustrated in FIG. 16B.

Gearboxes suitable for use as gearbox 194 are well known in the art and may find use, for example, in the robotics industry. As an example only, a suitable gearbox is the Model No. RV320 gearbox available from the Nabteseo Corporation of Japan.

As indicated at 196 in FIGS. 8, 9 and 10A, the gearbox input shaft 202 is coupled to the gearbox 194 by brake 196. The brake 196, which is preferably a Weston brake, prevents the arch 44*a* from crashing down to the cargo deck 42 in the event that the handle of the tool 240 is released, or the tool becomes disengaged from the fitment 206, when the arch 44*a* is midway between the storage and use positions illustrated in FIGS. 16A and 16B. In addition, the brake 196 permits the arch 44*a* to be lowered to the cargo deck in a controlled fashion when the handle 240 is turned in the direction of arrow 266 of FIG. 16B. Arch 44*b* (FIG. 1A) is provided with a similar crank mechanism and functionality.

Figure 16B:
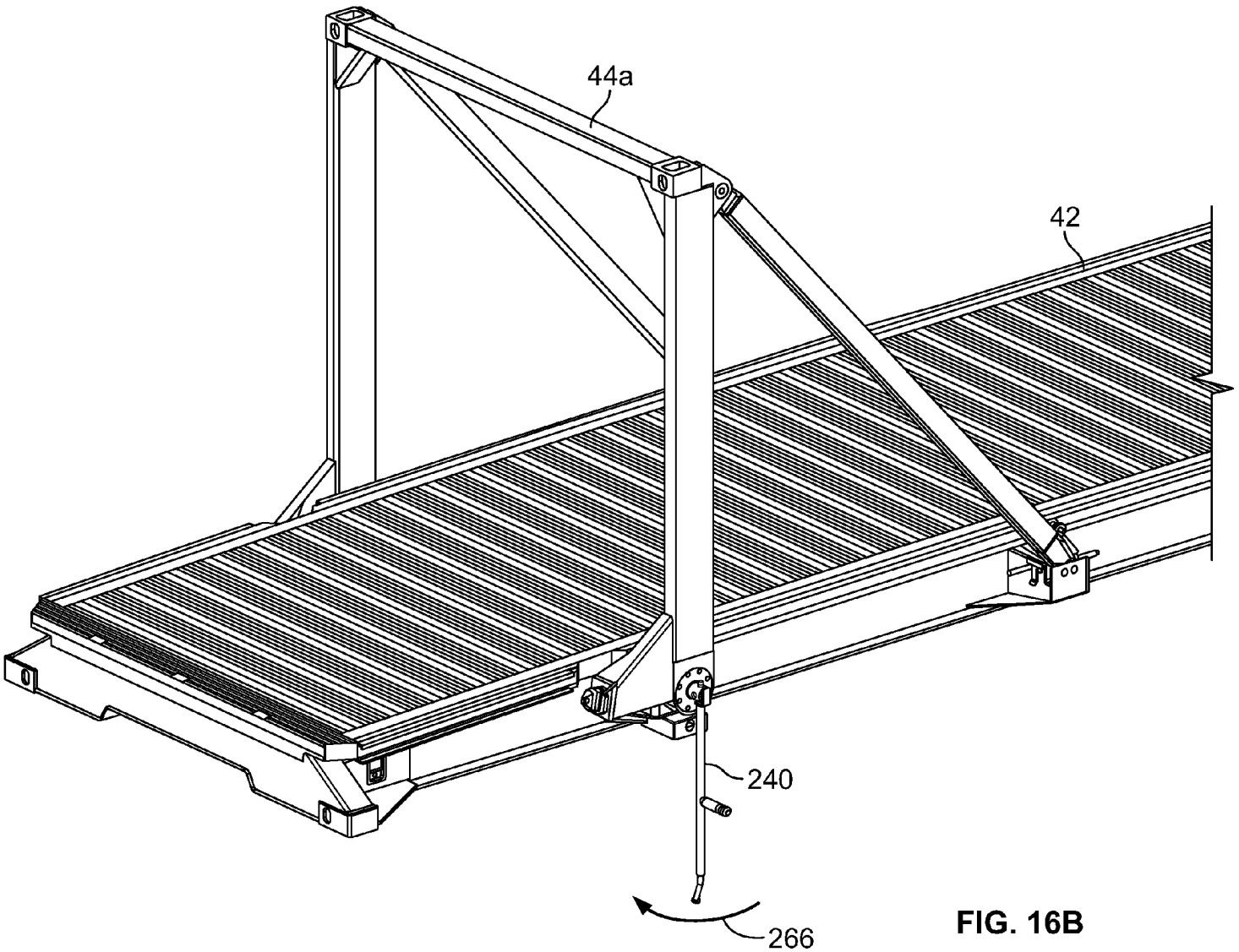
Figure 16C:
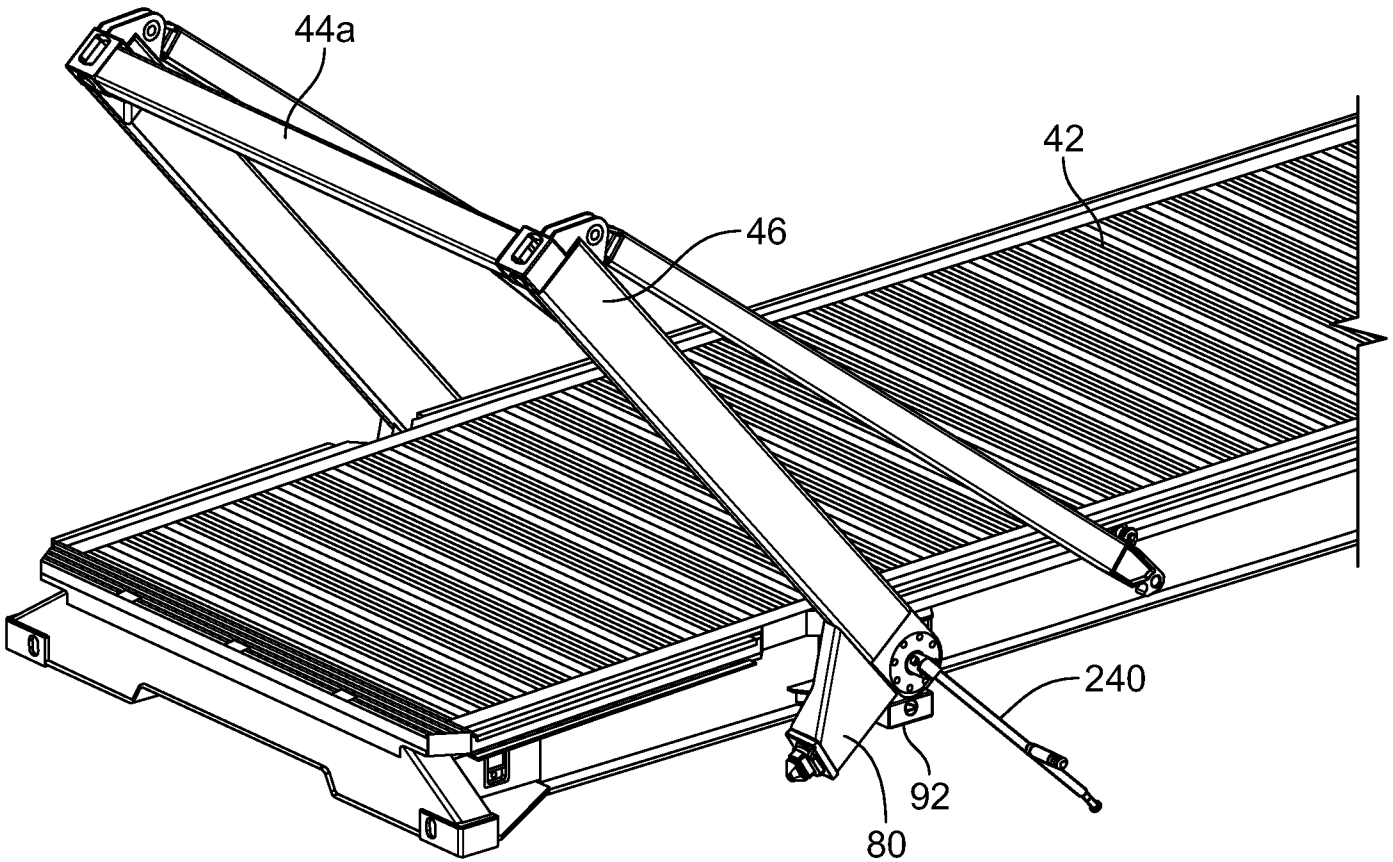

If the tool 240 is turned in the direction of arrow 262 of FIG. 16A when the arch 44*a* is in the position of FIG. 16B, the arch moves into the expanded load position illustrated in FIG. 16C. The braking action of the brake 196 (FIGS. 8, 9 and 10A) may only operate on the motion of the arch moving between the storage and use positions (FIGS. 16A and 16B). Nevertheless, when the arch 44*a* travels from the use position illustrated in FIG. 16B to the expanded load position illustrated in FIG. 16C, the gearbox has enough resistance to lower the arch in a controlled manner until the stacking blocks 80 contact corresponding stacking supports 90, which serve as stops. The stacking block and corresponding stacking support are illustrated at 80 and 92, respectively, in FIG. 16C for upright post 46. Upright post 48 of FIG. 1A and the upright posts of arch 44*b* are also provided with stacking blocks and corresponding slacking supports and operate as stops in the same manner.

With reference to FIG. 1A, as described above, the lower end of upright post 46 is pivotally attached to the cargo deck with a crank mechanism to raise and lower the arch 44*a*, while the lower end of upright post 48 is merely pivotally attached by way of a bearing arrangement. As a result, upright post 46 has a natural tendency to lead upright post 48 as the arch 44*a* is raised from the storage position into the use position. This would make locking the lower end of support brace 56 into its corresponding brace locking assembly difficult. To address this issue, arch 44*a* is preferably constructed to include a slight counterclockwise (looking down) twist with respect to axis 268 of FIG. 1A so that upright post 48 leads upright post 46 in the direction of arrow 270 (FIG. 1A) as the arch is moved from the storage to the use position. This causes the bottom end of support brace 56 to reach its corresponding brace locking assembly prior to brace 54. The bottom end of brace 54 may then be pulled into its corresponding brace locking assembly (120 in FIGS. 4A-7) as the crank mechanism is actuated to move the arch 44*a* into the upright position. Arch 44*b* features a similar construction and operation.

Figure 17:
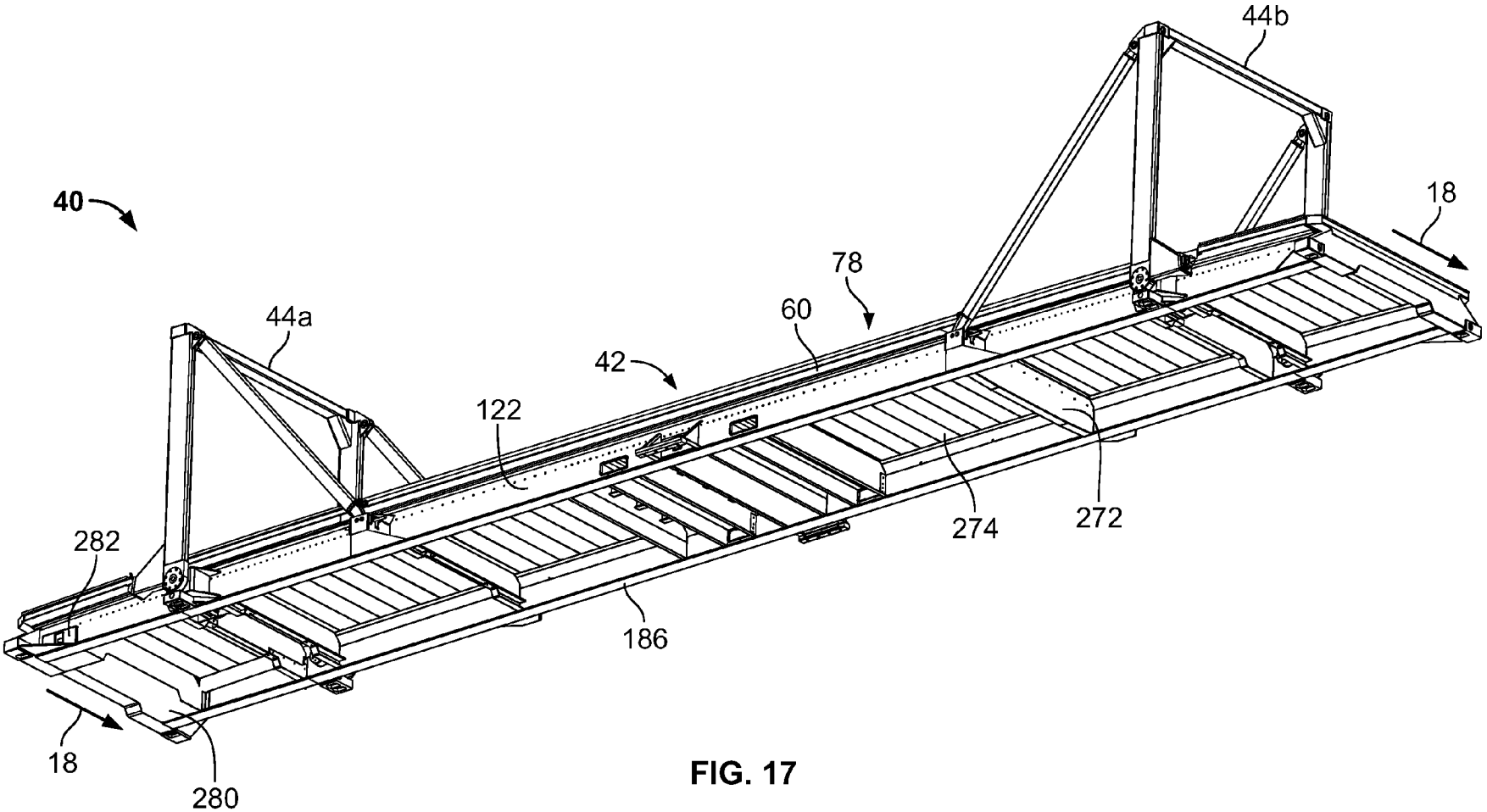
FIG. 17 is bottom perspective view of the collapsible intermodal flat rack of FIG. 1A.
Figure 18:
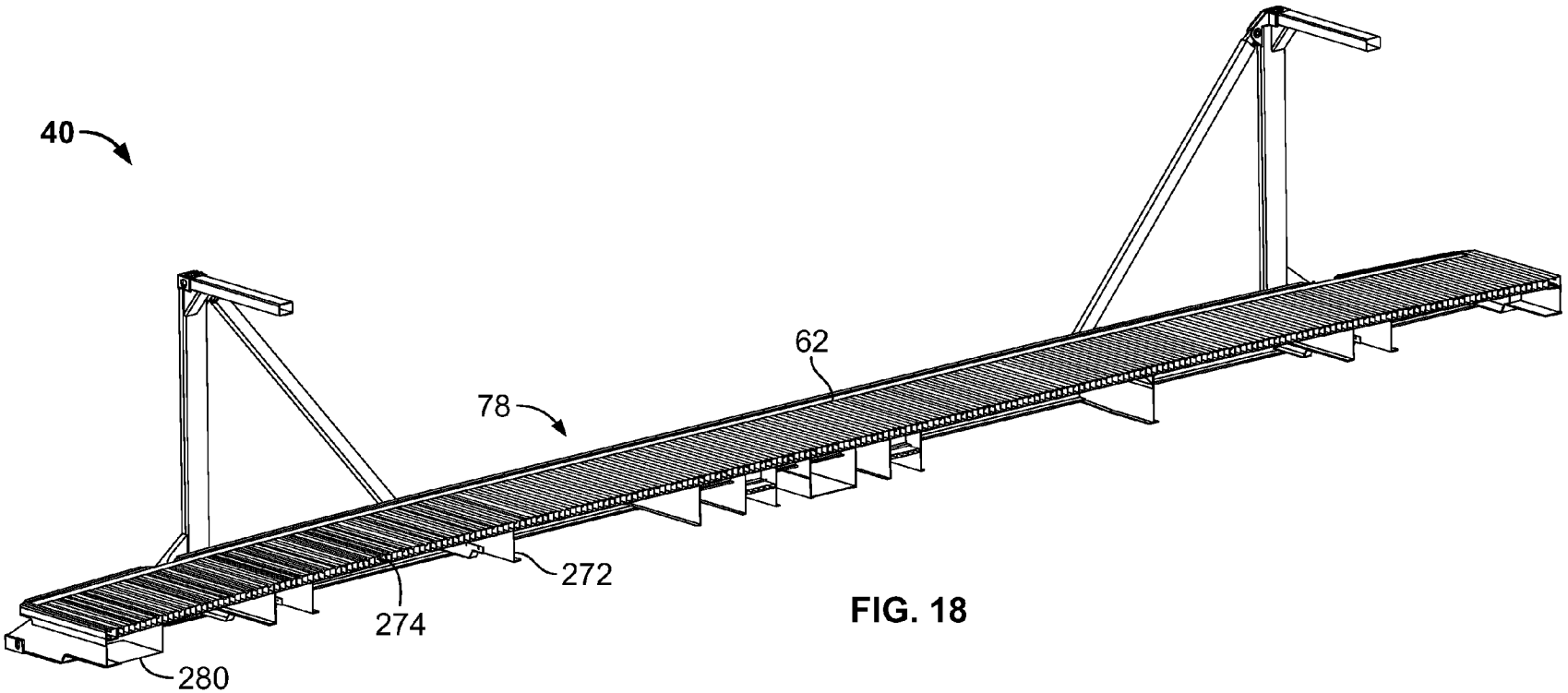
FIG. 18 is a cross sectional perspective view of the flat rack of FIG. 17 taken along line 18-18 of FIG. 17.
Figure 19:
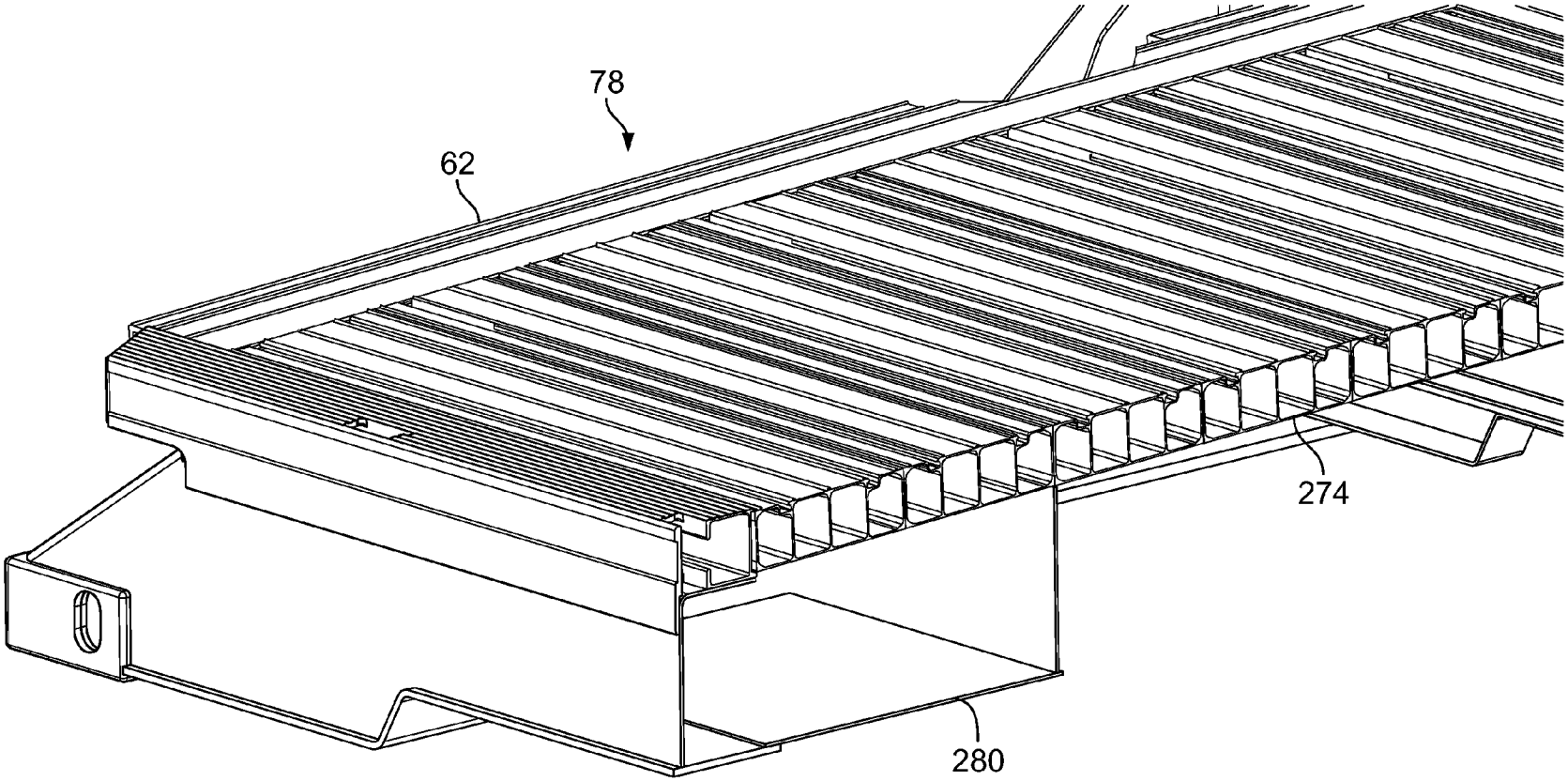
FIG. 19 is an enlarged cross sectional perspective view of a portion of the flat rack of FIG. 18.

The construction of the cargo deck 42 is best illustrated in FIGS. 17-19. The cargo deck features a pair of main beams 122 and 186 which are joined by a number of cross beams, such as cross beam 272. The main beams and cross beams are preferably constructed from steel although aluminum may be used for some of the beams as a lighter alternative. The floor 78 of the cargo deck is bordered on each side by channels 60 and 62 (FIGS. 11 and 18). As illustrated in FIGS. 17-19, the floor 78 is made up of a number of hollow plank members 274 that are preferably aluminum and joined or formed in a side-by-side configuration to form a unitary aluminum construction, such as that of the REVOLUTION flatbed trailer from the Fontaine Trailer Company of Haleyville, Ala. In addition, a steel box 280 serves as one of the cross beams near an end of the flat rack. As illustrated in FIG. 17, a door 282 formed in the main beam 122 provides access to the interior of the box 280 so that tools and other items may be stored.

The flat rack floor 78 may be provided with channels for receiving sliding load securing brackets, as illustrated in commonly assigned U.S. Pat. Nos. 7,571,953 and 8,057,143, the contents of which are hereby incorporated by reference. In addition, the channels 60 (FIG. 17) and 62 (FIG. 19) may be incorporated into the flat rack cargo deck via a one-piece side rail as illustrated in commonly owned U.S. Pat. Nos. 7,588,754 and 7,896,427, the contents of which are hereby incorporated by reference.

Figure 20:
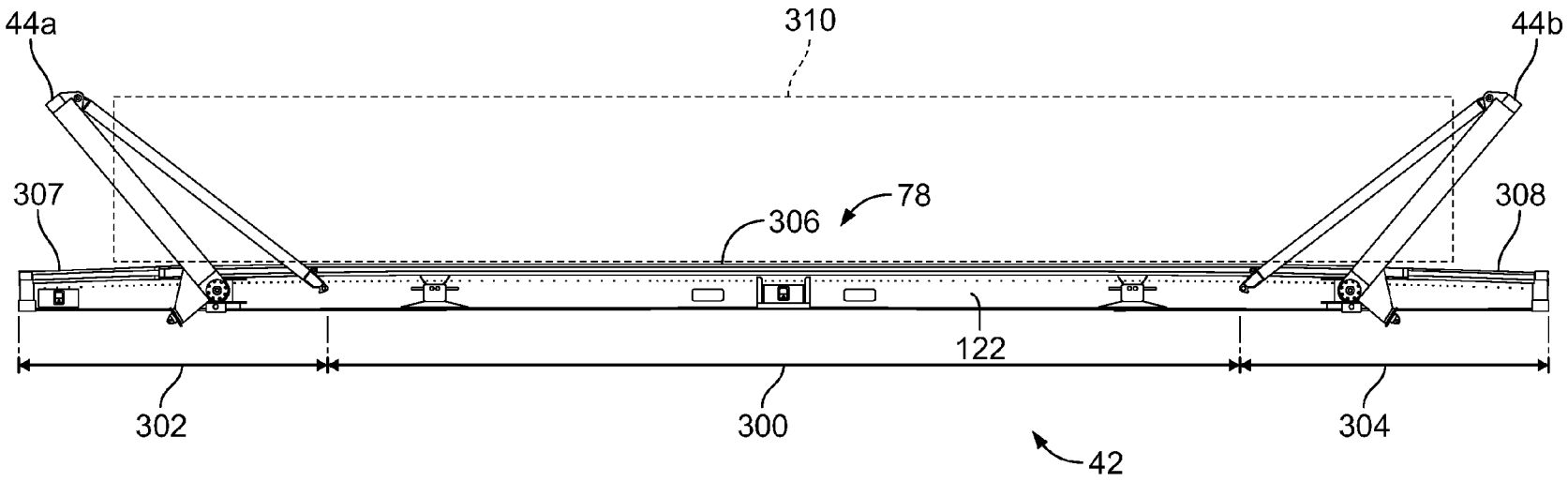
FIG. 20 is a side elevational view of the collapsible intermodal flat rack of FIG. 1B

As illustrated in FIG. 20, the cargo deck 42 preferably features three zones including a central zone, indicated by arrow 300, flanked by end zones 302 and 304. Central zone 300 features a flat top surface 306 of floor 78 while end zones 302 and 304 each feature top surfaces 307 and 308, respectively, that taper down from the flat top surface 306 to opposite ends of the flat rack. Main beams 122 and 186 include fop profiles to accommodate these three zones. The flat central zone 300 provides the advantage of a level surface to support oversized loads, such as the load indicated in phantom at 310 in FIG. 20, which must be loaded from overhead with arches 44*a* and 44*b* in the expanded load positions illustrated. More specifically, by provided a flat support surface under the majority of the load 310, there is no "teeter-totter" effect on the load, which increases load stability. The tapered end zones 302 and 304 provide a reduction of material and weight savings.

As an example only, central zone 300 may have a length of approximately 27.5 feet, with each end zone 302 and 304 having a length of approximately 12.75 feet long. This would be, for example, for a flat rack having a height of 9.5 feet (when in the use position illustrated in FIG. 1A), a width of 8.5 feet (to match the dimensions of a domestic container) and a length of 53 feet.

Figure 21:
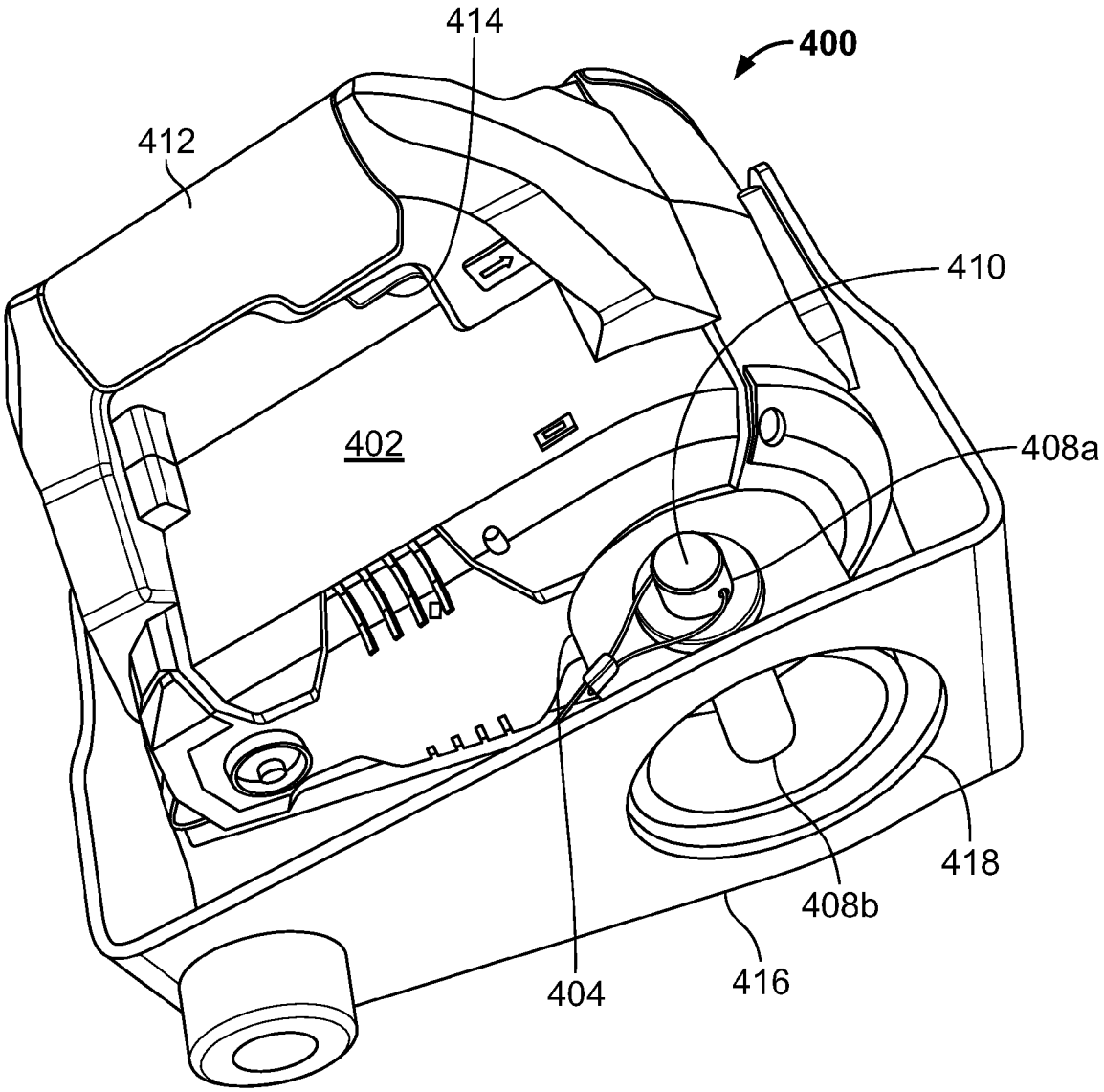
FIG. 21 is a perspective view of a battery-powered tool for operation of the cranking mechanism of FIGS. 8-13B.

A battery-powered tool for operating the cranking mechanism is indicated in general at 400 in FIG. 21. As illustrated in FIG. 21, the battery-powered tool features a housing 402 which contains the tool's battery and motor. The battery powers the motor which turns socket or sleeve 404. Socket 404 is sized to receive the crank mechanism fitment 206 (FIGS. 15A and 15B). The socket features an aligned pair of pin holes 408*a* and 408*b*. In use, a pair of the tool holes (210 in FIGS. 15A and 15B) of the crank mechanism fitment are aligned with the pin holes 408*a* and 408*b* when the fitment 206 is positioned within the socket 404. A locking pin 410 is then inserted through the pin holes of the socket 404 and the tool holes 210 of the crank mechanism fitment so that the fitment is locked within the socket. The user, while grasping handle 412 of the battery-powered tool, squeezes trigger 414 so that the tool motor is activated and the socket 404 is turned so as to turn the cranking mechanism to raise and lower the arches (44*a* and 44*b* of FIG. 20) of the intermodal flat rack. The tool features a guard 416, having an opening 418 corresponding to socket 404, to prevent accidental contact with the turning socket 404.

While the preferred embodiments of the invention have been shown and described, it will be apparent to those skilled in the art that changes and modifications may be made therein without departing from the spirit of the invention, the scope of which is defined by the appended claims.

What is claimed is:

1. A collapsible intermodal flat rack comprising:

a) a cargo deck;

b) an arch including a first upright post and a second upright post, each of said first and second upright posts having a top end portion and a bottom end portion, with the top end portions of the first and second upright posts joined by a top cross member;

c) the bottom end portions of said first and second upright posts pivotally connected to said cargo deck; and d) a crank mechanism including a gearbox having an input shaft and an output shaft, said input shaft rotationally connected to the cargo deck and having a first end connected to the gearbox and a second end adapted to be engaged by a user to rotate the input shaft and said output shaft rotationally connected to the cargo deck and separate and spaced from the input shaft and having a first end connected to the gearbox and a second end attached to a bottom portion of the first upright post so that said arch may be moved between a storage position, where the top cross member is located adjacent to the cargo deck, and a use position, where the top cross member of the arch is elevated from the cargo deck, by actuation of the gearbox through the input shaft.

2. The collapsible intermodal flat rack of claim 1 further comprising a first lifting fitment connected to the top end portion of the first upright post and a second lifting fitment connected to the top end portion of the second upright post.

3. The intermodal flat rack of claim 1 further comprising a first stacking block attached to the bottom end portion of the first upright post and a second stacking block attached to the bottom end portion of the second upright post, said first and second stacking blocks each including stacking pads that are positioned above the cargo deck when the arch is in the storage position and below the cargo deck when the arch is in the use position.

4. The intermodal flat rack of claim 3 wherein the stacking pads may be repositioned to reveal lifting fitments.

5. The intermodal flat rack of claim 1 further comprising a first support brace having a top end pivotally attached to the top end portion of the first upright post and a second support brace having a top end pivotally attached to the top end portion of the second upright post, where the bottom ends of the first and second support braces are attached to the cargo deck in a movable fashion.

6. The intermodal flat rack of claim 5 further comprising a first channel positioned along a first side of the cargo deck and a second channel positioned along a second side of the cargo deck, and wherein the bottom end of the first support brace includes a first roller positioned within the first channel and the bottom end of the second support brace includes a second roller positioned within the second channel so that the first and second rollers remain within and travel within the first and second channels as the arch is moved between the storage and use positions.

7. The intermodal flat rack of claim 6 wherein the bottom end portion of the first support brace includes a hook portion formed therein and a lock opening also formed within the bottom end portion of the first support with the hook portion adjacent to the lock opening and further comprising a brace locking assembly including:

i) a pin housing positioned adjacent to said first channel;

ii) a stop pin positioned within the pin housing and slidable between an extended position and a retracted position along a stop pin sliding axis;

iii) a locking pin positioned within the pin housing and slidable between an extended position and a retracted position along a locking pin sliding axis that is generally parallel to the stop pin sliding axis;

iv) said hook portion of the first support brace engaging said stop pin when the arch is in the use position and the stop pin is in the extended position;

v) said locking pin engaging the locking hole of the first support brace when the locking pin is moved from the retracted position to the extended position while the arch is in the use position.

8. The intermodal flat rack of claim 7 wherein the cargo deck features an end and a longitudinal midpoint, and wherein the arch moves towards the longitudinal midpoint as it moves from the use to the storage position, said arch also pivoting away from the use point towards the end of the cargo deck into an expanded load position and wherein said stop pin and lock pin are moved into the retracted positions so that the hook portion and locking hole of the first support brace are released to permit movement of the arch to the expanded load position.

9. The intermodal flat rack of claim 7 further comprising a handle on the locking pin and a handle on the stop pin, said locking and stop pin handles extending out of said pin housing.

10. The intermodal flat rack of claim 1 wherein the cargo deck features an end and a longitudinal midpoint, and wherein the arch moves towards the longitudinal midpoint as it moves from the use to the storage position, said arch also pivoting away from the use point towards the end of the cargo deck into an expanded load position.

11. The intermodal flat rack of claim 1 further comprising an inner bearing tube and an outer bearing tube wherein the bottom end portion of the first upright post is connected to the inner bearing tube and the outer bearing tube is connected to the cargo deck and the inner bearing tube is pivotally received within the outer bearing tube.

12. The intermodal flat rack of claim 11 further comprising a telescoping arm attached to the input shaft in a sliding fashion and a crank mechanism fitment attached to an end of the telescoping arm so that said crank mechanism fitment may be moved between a retracted position, where said crank mechanism fitment is positioned within the inner bearing tube, and an extended position where said crank mechanism fitment is extended out from the inner bearing tool for access and actuation by a user.

13. The intermodal flat rack of claim 12 wherein the crank mechanism fitment includes an end opening featuring an annular flange which may be engaged by a tool to enable moving of the crank mechanism housing from the retracted position to the extended position.

14. The intermodal flat rack of claim 1 wherein the input shaft of the gearbox is provided with a Weston brake.

15. The intermodal flat rack of claim 1 wherein the cargo deck features a pair of end zones and a central zone, where the central zone features a top surface that is non-arcuate and generally level and the pair of end zones each features a top surface that taper downwards in a generally linear fashion towards ends of the cargo deck.

16. A collapsible intermodal flat rack a) a cargo deck;

b) a first arch pivotally mounted to the cargo deck;

c) a first crank mechanism including a gearbox having an input shaft and an output shaft, said input shaft rotationally connected to the cargo deck and having a first end connected to the gearbox and a second end adapted to be engaged by a user to rotate the input shaft and said output shaft rotationally connected to the cargo deck and separate and spaced from the input shaft and having a first end connected to the gearbox and a second end attached to the first arch so that said first arch may be moved between a storage position, where a top portion of the first arch is located adjacent to the cargo deck, and a use position, where the top portion of the first arch is elevated from the cargo deck, by actuation of the gearbox through the input shaft.

17. The collapsible intermodal flat rack of claim 16 further comprising:

d) a second arch pivotally mounted to the cargo deck;

e) a second crank mechanism including a gearbox having an input shaft and an output shaft, said output shaft attached to the second arch so that said second arch may be moved between a storage position, where a top portion of the first arch is located adjacent to the cargo deck, and a use position, where the top portion of the second arch is elevated from the cargo deck, by actuation of the input shaft.

18. The collapsible intermodal flat rack of claim 16 further comprising a pair of lifting fitment connected to the top portion of the first arch.

19. The intermodal flat rack of claim 16 further comprising a pair of stacking blocks attached to a bottom portion of the first arch, said pair of stacking blocks each including stacking pads that may be moved to reveal lifting fitments and that are positioned above the cargo deck when the first arch is in the storage position and below the cargo deck when the first arch is in the use position.

20. The intermodal flat rack of claim 16 further comprising a first and second support braces, each having a top end pivotally attached to the top portion of the first arch, where the bottom ends of the first and second support braces are attached to the cargo deck in a movable fashion.

21. The intermodal flat rack of claim 20 further comprising a first channel positioned along a first side of the cargo deck and a second channel positioned along a second side of the cargo deck, and wherein the bottom end of the first support brace includes a first roller positioned within the first channel and the bottom end of the second support brace includes a second roller positioned within the second channel so that the first and second rollers remain within and travel within the first and second channels as the first arch is moved between the storage and use positions.

22. The intermodal flat rack of claim 21 wherein the bottom end portion of the first support brace includes a hook portion formed therein and a lock opening also formed within the bottom end portion of the first support with the hook portion adjacent to the lock opening and further comprising a brace locking assembly including:

i. a pin housing positioned adjacent to said first channel;

ii. a stop pin positioned within the pin housing and slidable between an extended position and a retracted position along a stop pin sliding axis;

iii. a locking pin positioned within the pin housing and slidable between an extended position and a retracted position along a locking pin sliding axis that is generally parallel to the stop pin sliding axis;

iv. said hook portion of the first support brace engaging said stop pin when the arch is in the use position and the stop pin is in the extended position;

v. said locking pin engaging the locking hole of the first support brace when the locking pin is moved from the retracted position to the extended position while the arch is in the use position.

23. The intermodal flat rack of claim 22 wherein the cargo deck features an end and a longitudinal midpoint, and wherein the first arch moves towards the longitudinal midpoint as it moves from the use to the storage position, said first arch also pivoting away from the use point towards the end of the cargo deck into an expanded load position and wherein said stop pin and lock pin are moved into the retracted positions so that the hook portion and locking hole of the first support brace are released to permit movement of the first arch to the expanded load position.

24. The intermodal flat rack of claim 22 further comprising a handle on the locking pin and a handle on the stop pin, said locking and stop pin handles extending out of said pin housing.

25. The intermodal flat rack of claim 16 wherein the cargo deck features an end and a longitudinal midpoint, and wherein the first arch moves towards the longitudinal midpoint as it moves from the use to the storage position, said arch also pivoting away from the use point towards the end of the cargo deck into an expanded load position.

26. The intermodal flat rack of claim 16 further comprising an inner bearing tube and an outer bearing tube wherein a bottom portion of the first arch is connected to the inner bearing tube and the outer bearing tube is connected to the cargo deck and the inner bearing tube is pivotally received within the outer bearing tube.

27. The intermodal flat rack of claim 26 further comprising a telescoping arm attached to the input shaft in a sliding fashion and a crank mechanism fitment attached to an end of the telescoping arm so that said crank mechanism fitment may be moved between a retracted position, where said crank mechanism fitment is positioned within the inner bearing tube, and an extended position where said crank mechanism fitment is extended out from the inner bearing tube for access and actuation by a user.

28. The intermodal flat rack of claim 27 wherein the crank mechanism fitment includes an end opening featuring an annular flange which may be engaged by a tool to enable moving of the crank mechanism housing from the retracted position to the extended position.

29. The intermodal flat rack of claim 27 wherein the crank mechanism fitment includes a plurality of tool holes adapted to be engaged by a tool to actuate the first crank mechanism to move the first arch between the storage position and the use position.

30. The intermodal flat rack of claim 29 further comprising a tool having:

i. an elongated body having a first end including a reduced diameter portion sized to be positioned through at least one of the plurality of tool holes of the crank mechanism fitment;

ii. a handle attached to the elongated body;

iii. an angled guide attached to the elongated body and positioned over the reduced diameter portion of the first end in a spaced relationship to permit the reduced diameter portion to be positioned through the at least one of the plurality of tool holes.

31. The intermodal flat rack of claim 30 wherein the reduced diameter portion of the first end of the tool features a spring ball sized and positioned to engage one of the plurality of tool holes of the crank mechanism fitment when the reduced diameter portion of the first end of the tool is positioned in at least one of the plurality of tool holes of the crank mechanism fitment.

32. The intermodal flat rack of claim 30 wherein the crank mechanism fitment includes an end opening featuring an annular flange and the tool further includes a second end having a tapered diameter so that a pick having a tip is formed, said pick including a circumferential bead formed around the tip of the pick and sized to engage the end opening of the crank mechanism fitment to enable moving of the crank mechanism housing from the retracted position to the extended position.

33. The intermodal flat rack of claim 29 further comprising a tool having:

i. a housing containing a motor and a battery;

ii. a switch mounted on the housing, said battery powering said motor when said switch is actuated;

iii. a sleeve connected to the motor so that the sleeve turns when the motor is powered by the battery, said sleeve sized to receive the crank mechanism fitment, said sleeve including a pin hole;

iv. a locking pin sized to be positioned through at least one of the plurality of locking holes of the crank mechanism fitment and the pin hole of the sleeve when the crank mechanism fitment is positioned within the sleeve.

34. The intermodal flat rack of claim 16 wherein the input shaft of the gearbox is provided with a Weston brake.

35. The intermodal flat rack of claim 16 wherein the cargo deck features a pair of end zones and a central zone, where the central zone features a top surface that is non-arcuate and generally level and the pair of end zones each features a top surface that taper downwards in a generally linear fashion towards ends of the cargo deck.

36. The intermodal flat rack of claim 1 wherein the output shaft is tubular and the input shaft is positioned through the tubular output shaft so that the input shaft is generally concentric with the output shaft.

37. The intermodal flat rack of claim 16 wherein the output shaft is tubular and the input shaft is positioned through the tubular output shaft so that the input shaft is generally concentric with the output shaft.

* * * * *